US011355848B2

(12) United States Patent
Coupez

(10) Patent No.: US 11,355,848 B2
(45) Date of Patent: Jun. 7, 2022

(54) MULTIBAND ANTENNA ARRANGEMENT BUILT TO A SPECIFICATION FROM A LIBRARY OF BASIC ELEMENTS

(71) Applicant: INSTITUT MINES TELECOM—IMT ATLANTIQUE—BRETAGNE—PAYS DE LA LOIRE, Brest (FR)

(72) Inventor: Jean-Philippe Coupez, Brest (FR)

(73) Assignee: INSTITUT MINES TELECOM—IMT ATLANTIQUE—BRETAGNE—PAYS DE LA LOIRE, Brest (FR)

( * ) Notice: Subject to any disclaimer, the term of this patent is extended or adjusted under 35 U.S.C. 154(b) by 25 days.

(21) Appl. No.: 17/255,407

(22) PCT Filed: Jun. 27, 2019

(86) PCT No.: PCT/EP2019/067252
§ 371 (c)(1),
(2) Date: Dec. 22, 2020

(87) PCT Pub. No.: WO2020/007718
PCT Pub. Date: Jan. 9, 2020

(65) Prior Publication Data

US 2021/0376470 A1 Dec. 2, 2021

(30) Foreign Application Priority Data

Jul. 6, 2018 (EP) ..... 18305898

(51) Int. Cl.
*H01Q 9/40* (2006.01)
*H01Q 5/371* (2015.01)
*H01Q 21/30* (2006.01)

(52) U.S. Cl.
CPC ..... *H01Q 5/371* (2015.01); *H01Q 9/40* (2013.01); *H01Q 21/30* (2013.01)

(58) Field of Classification Search
CPC ..... H01Q 21/30; H01Q 9/40; H01Q 5/371
See application file for complete search history.

(56) References Cited

U.S. PATENT DOCUMENTS

2004/0001031 A1 1/2004 Sugimoto et al.
2018/0053999 A1 2/2018 Coupez
(Continued)

FOREIGN PATENT DOCUMENTS

EP 3 285 333 A1 2/2018
EP 3 340 379 A1 6/2018
(Continued)

OTHER PUBLICATIONS

Michielssen, et al., "Design of multilayered FSS and waveguide filters using genetic algorithms", Proceedings of IEEE Antennas and Propagation Society International Symposium, Jul. 2, 1993.
Garbacz, et al., "A generalized expansion for radiated and scattered fields", IEEE Trans. Antennas Propagation, vol. AP-19, No. 3, pp. 348-358, May 1971.
(Continued)

*Primary Examiner* — Graham P Smith
(74) *Attorney, Agent, or Firm* — BakerHostetler

(57) ABSTRACT

An antenna arrangement that is designed to match, or approach based on a cost function, a specification includes a list of a plurality of predefined frequencies and, possibly a list of predefined bandwidths at a matching level. The antenna arrangement is designed using a plurality of predefined elements comprising a primary conductive element defined as a main trunk and a combination of secondary conductive elements selected from trunks, branches or leaves. The primary conductive element and the secondary conductive elements are defined by design parameters that comprise a susceptance that is a function of a geometry, a form factor, a main dimension, an orientation of the sec-
(Continued)

ondary conductive elements relative to the primary conductive element and a position of the secondary conductive elements on the primary conductive element. The antenna arrangement may be further defined to match a predefined form factor.

20 Claims, 20 Drawing Sheets

(56) References Cited

U.S. PATENT DOCUMENTS

| | | | |
|---|---|---|---|
| 2018/0183144 | A1 | 6/2018 | Coupez |
| 2020/0373664 | A1 | 11/2020 | Coupez |

FOREIGN PATENT DOCUMENTS

| | | | |
|---|---|---|---|
| WO | 01/22528 | A1 | 3/2001 |
| WO | 03/034544 | A1 | 4/2003 |
| WO | 2015/007746 | A1 | 1/2015 |

OTHER PUBLICATIONS

Harrington, et al.,"Theory of characteristic modes for conducting bodies", IEEE Trans. Antennas Propagation, vol. AP-19, No. 5, pp. 622-628, Sep. 1971.

Harrington, et al., "Computation of characteristic modes for conducting bodies", IEEE Trans. Antennas Propagation, vol. AP-19, No. 5, pp. 629-639, Sep. 1971.

Harrington, et al., "Characteristic modes for dielectric and magnetic bodies", IEEE Trans. Antennas Propagation, vol. AP-20, No. 2, pp. 194-198, Mar. 1972.

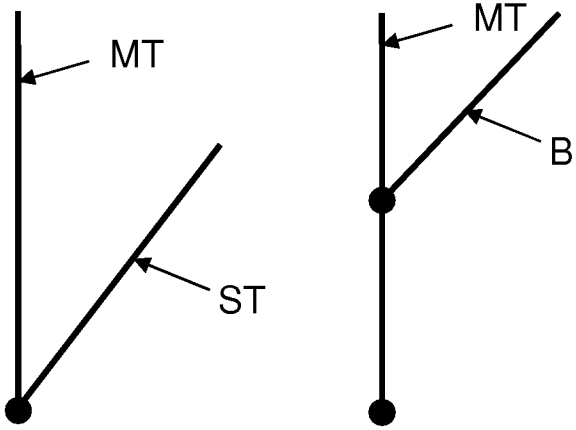
FIG.6a
FIG.6b
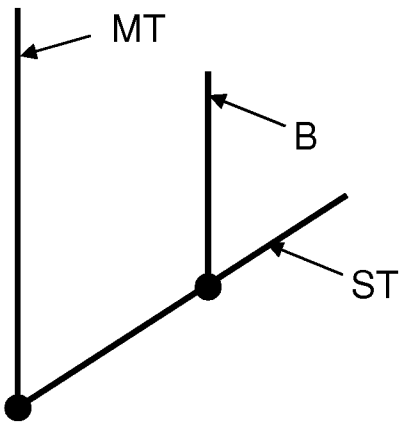
FIG.6c
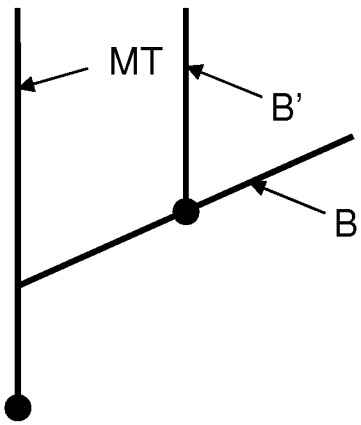
FIG.6d
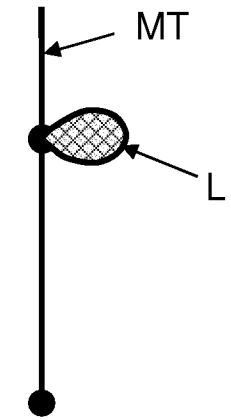
FIG.6e
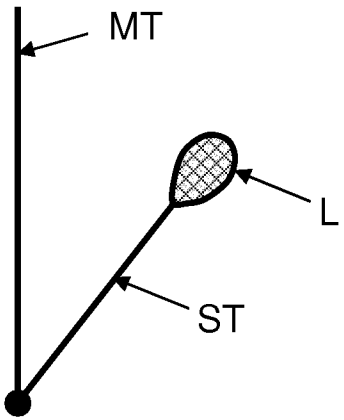
FIG.6f
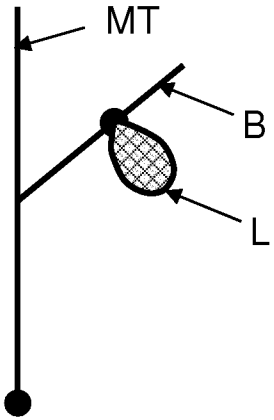
FIG.6g

MULTIBAND ANTENNA ARRANGEMENT BUILT TO A SPECIFICATION FROM A LIBRARY OF BASIC ELEMENTS

CROSS-REFERENCE TO RELATED APPLICATIONS

This application is a National Stage of International patent application PCT/EP2019/067252, filed on Jun. 27, 2019, which claims priority to foreign European patent application No. EP 18305898.1, filed on Jul. 6, 2018, the disclosures of which are incorporated by reference in their entirety.

FIELD OF THE INVENTION

The invention relates to antenna arrangements having a plurality of frequency modes in the VHF, UHF, S, C, X or higher frequency bands. More precisely, an antenna arrangement of a compact form factor may be designed according to the invention to match a specification and built from a library of basic elements such as primary of secondary trunks, branches and leaves. Thanks to the invention, a designer of such antenna arrangements may be provided with tools and libraries that greatly improve his/her efficiency in the development of antennas.

BACKGROUND

There is a need for terminals or smartphones on-board aircraft, ships, trains, trucks, cars, or carried by pedestrians to be connected while on the move. All kinds of objects on-board vehicles or located in a manufacturing plant, an office, a warehouse, a storage facility, retail establishments, hospitals, sporting venues, or a home are connected to the Internet of Things (IoT): tags to locate and identify objects in an inventory or to keep people in or out of a restricted area; devices to monitor physical activity or health parameters of their users; sensors to capture environmental parameters (concentration of pollutants, hygrometry, wind speed, etc.); actuators to remotely control and command all kinds of appliances, or more generally, any type of electronic device that could be part of a command, control, communication and intelligence system, the system being for instance programmed to capture/process signals/data, transmit the same to another electronic device, or a server, process the data using processing logic implementing artificial intelligence or knowledge based reasoning and return information or activate commands to be implemented by actuators.

RF communications are more versatile than fixed-line communications for connecting these types of objects or platforms. As a consequence, radiofrequency T/R modules are and will be more and more pervasive in professional and consumer applications. A plurality of T/R modules may be implemented on the same device. By way of example, a smartphone typically includes a cellular communications T/R module, a Wi-Fi/Bluetooth T/R module, a receiver of satellite positioning signals (from a Global Navigation Satellite System or GNSS). Wi-Fi™, Bluetooth™ and 3 or 4G cellular communications are in the 2.5 GHz frequency band (S-band). GNSS receivers typically operate in the 1.5 GHz frequency band (L-band). RadioFrequency IDentification (RFID) tags operate in the 900 MHz frequency band (UHF) or lower. Near Field Communication (NFC) tags operate in the 13 MHz frequency band (HF) at a very short distance (about 10 cm).

It seems that a good compromise for IoT connections lies in VHF or UHF bands (30 to 300 MHz and 300 MHz to 3 GHz) to get sufficient available bandwidth and range, a good resilience to multipath reflections as well as a low-power budget.

A problem to be solved for the design of T/R modules at these frequency bands is to have antennas which are compact enough to fit in the form factor of a connected object. A traditional omnidirectional antenna of a monopole type, adapted for VHF bands, has a length between 25 cm and 2.5 m ($\lambda/4$). A solution to this problem is notably provided by PCT application published under n° WO2015007746, which has the same inventor and is co-assigned to the applicant of this application. This application discloses an antenna arrangement of a bung type, where a plurality of antenna elements are combined so that the ratio between the largest dimension of the arrangement and the wavelength may be much lower than a tenth of a wavelength, even lower than a twentieth or, in some embodiments than a fiftieth of a wavelength. To achieve such a result, the antenna element which controls the fundamental mode of the antenna is wound up in a 3D form factor, such as, for example, a helicoid, so that its outside dimensions are reduced relative to its length.

But there is also a need for the connected devices to be compatible with terminals which communicate using Wi-Fi or Bluetooth frequency bands and protocols. In this use case, some stages of the T/R module have to be compatible with both VHF and S bands. If a GNSS receiver is added, a T/R capacity in the L band is also needed. This means that the antenna arrangements of such devices should be able to communicate simultaneously or successively in different frequency bands. Adding as many antennas as frequency bands is costly in terms of form factor, power budget and materials. This creates another challenging problem for the design of the antenna. Some solutions are disclosed for base station antennas by PCT applications published under n° WO2001/22528 and WO2003/34544. But these solutions do not operate in VHF bands and do not provide arrangements which would be compact enough in these bands.

The applicant of this application has filed a European patent application published under n° EP3285333 that has the same inventor as this application. This application discloses a "bonsai" antenna arrangement, i.e. an antenna arrangement comprising: a first conductive element configured to radiate above a defined frequency of electromagnetic radiation; one or more additional (or secondary) conductive elements located at or near one or more positions defined as a function of positions of nodes of current (i.e. zero current or Open Circuit—OC—positions) of harmonics of the electromagnetic radiation.

The bonsai antenna arrangement disclosed by the said patent application provides a certain flexibility to adjust the radiating frequencies of the antenna around the higher order modes of the "trunk" antenna, thanks to "leaves" that are placed by the designer of the antenna arrangement at selected spots on the trunk. But this flexibility is constrained in certain limits. Notably, the number of frequencies that may be adjusted on a same trunk should in practice be limited to four (fundamental mode plus the three first higher order modes), to avoid electromagnetic coupling between the leaves added to the trunk. Also, the length of the leaves should remain a fraction of the length of the trunk to avoid perturbing the other modes, so that the shift in frequency is limited to a fraction of the value of the radiating frequency of each mode. Therefore, it is not possible to implement any kind of selected frequencies on an antenna arrangement of the type disclosed by this first patent application.

Some limitations of this prior art have been overcome to a certain extent by providing an addition of secondary trunks and/or branches to a primary trunk to increase the number of resonating frequencies of the antenna arrangement and enlarge its frequency domain of use, as disclosed by European patent application filed under n° EP2017/306929.5 with the same inventor and the same applicant as the instant application.

Also, this first application does not disclose how to control bandwidth around a resonating frequency. This drawback has been overcome to a certain extent by providing an addition of other resonating elements to a primary trunk at controlled positions to form a resonating structure of an order higher than one at a frequency of one of the selected harmonics of the electromagnetic radiation of the primary trunk, as disclosed by European patent application filed under n° EP2016/306768.9 with the same inventor and the same applicant as the instant application.

These three patent applications disclose design methods associated to the antenna arrangements that they disclose. But there is still a need for an antenna arrangement of a bonsai type that could be designed easily and rapidly to match a typical specification and then built to this design from a library of elementary components using design tools that are accessible to a person of ordinary skill in the design of antennas.

The instant patent application overcomes these limitations to a significant extent.

SUMMARY OF THE INVENTION

The invention fulfills this need by providing an antenna arrangement that is built from primary and secondary elements that can be drawn from a library of trunks, branches and/or leaves that are configurable and can be assembled according to a set of design rules based on a number of design parameters, such as their electromagnetic susceptance to match a desired specification in terms of resonating frequencies, bandwidths and form factors.

More specifically, the invention discloses antenna arrangement comprising: a primary conductive element having defined geometric parameters, the primary conductive element having a proximal end and a distal end, the proximal end being connected at a feed line (210), the distal end being an open circuit position, the primary conductive element defining a first plurality of resonating frequencies; one or more secondary conductive elements, each having defined geometric parameters, a proximal end and a distal end, the proximal end being connected at a feed connection on the primary conductive element, the distal end being an open circuit position and defining an orientation relative to the primary conductive element, the one or more secondary conductive elements generating a second plurality of resonating frequencies; wherein the frequencies in the second plurality of resonating frequencies each satisfy a condition of resonance at the feed line, the condition of resonance being determined by a sequence of combinations of input susceptances of a segment of the primary conductive element and of one of the one or more secondary conductive elements, each combination being generated at the feed connection of the said one of the one or more secondary conductive elements on the primary conductive element, a segment of the primary conductive element connecting one of its distal end or a feed connection of another of the one or more secondary conductive elements to the one of the one or more secondary elements, the sequence starting from the distal end of the primary conductive element and ending at its proximal end.

Advantageously, the second plurality of resonating frequencies is deduced from the first plurality of resonating frequencies by one or more of shifting one or more frequency values, enlarging a bandwidth of one or more frequencies in the plurality of resonating frequencies, or adding one or more new resonating frequencies.

Advantageously, the input susceptance of a segment of the primary conductive element is determined by the defined geometric parameters of the said primary conductive element.

Advantageously, the input susceptance of each one of the one or more secondary conductive elements depends on the defined geometric parameters of the said each one of the one or more secondary conductive elements, and on its orientation relative to the primary conductive element.

Advantageously, the defined geometric parameters of the primary conductive element and of each one of the one or more secondary elements comprise a geometry, a form factor and a main dimension.

Advantageously, one of the one or more secondary conductive elements has a main dimension that is lower than a quarter of a wavelength corresponding to a highest value in the second plurality of resonating frequencies of the antenna arrangement, the addition of the one or more secondary conductive elements having an effect of shifting one or more of the first plurality of resonating frequencies of the antenna arrangement.

Advantageously, one of the one or more secondary conductive elements has a main dimension that is higher than a quarter of a wavelength corresponding to a highest value in the second plurality of resonating frequencies of the antenna arrangement and lower than a quarter of a wavelength corresponding to the lowest value in the second plurality of resonating frequencies of the antenna arrangement.

Advantageously, the addition of the one or more secondary conductive elements has an effect of adding one or more potential new resonating frequencies to the first plurality of resonating frequencies of the antenna arrangement, the new resonating frequencies having values in between a value corresponding to a wavelength equal to a quarter of the main dimension of the said one of the one or more secondary conductive elements and the highest value in the second plurality of resonating frequencies.

Advantageously, one or more of the potential new resonating frequencies are new resonating frequencies if they are sufficiently separated from the all frequency values in the first plurality of resonating frequencies.

Advantageously, the addition of the one of the one or more secondary conductive elements has an effect of shifting one or more resonating frequencies in the first plurality of resonating frequencies of the antenna arrangement having values in between the lowest value in the second plurality of resonating frequencies and a frequency value corresponding to a wavelength equal to a quarter of the main dimension of the said one of the one or more secondary conductive elements, when the one of the one or more secondary conductive elements has a feed connection that is not located at the feed line.

Advantageously, one of the one or more secondary conductive elements has an input susceptance that equals a characteristic admittance of an equivalent monopole antenna multiplied by a tangent of a coefficient multiplied by an equivalent length of the one of the one or more secondary conductive elements, the coefficient being equal to $2\pi f/c$ where f is one of the plurality of resonating frequencies and c is the speed of light.

Advantageously, the one of the one or more secondary conductive elements has a feed connection at a distance $\ell'$ of the distal end of the primary conductive element and at a distance $\ell''$ of the proximal end of the primary conductive element, its input susceptance equaling a characteristic admittance of an equivalent monopole antenna multiplied by a difference between a cotangent of a coefficient multiplied by $\ell$ and a tangent of a coefficient multiplied by $\ell'$, the coefficient being equal to $2\pi f/c$ where f is one of the plurality of resonating frequencies and c is the speed of light.

Advantageously, the one of the one or more secondary conductive elements has a feed connection at a distance $\ell'$ of the distal end of the primary conductive element and at a distance $\ell''+\ell''$ of the proximal end of the primary conductive element, the antenna arrangement further comprising another secondary conductive element having a feed connection at a distance $\ell$ from the feed connection of the one of the one or more secondary conductive elements and at a distance $\ell''$ from the feed line, the input susceptance of the another secondary conductive element equaling a characteristic admittance of an equivalent monopole antenna multiplied by a difference between a cotangent of a coefficient multiplied by $\ell''$ and a tangent of a coefficient multiplied by a sum of $\ell''$ and a length equivalent to the one of the one or more secondary conductive element in parallel with the segment connecting the distal end of the primary conductive element to the feed connection of the one of the one or more secondary conductive element, the coefficient being equal to $2\pi f/c$ where f is one of the plurality of resonating frequencies and c is the speed of light.

Advantageously, the antenna arrangement of the invention further comprises one or more ternary conductive, each having defined geometric parameters, a proximal end and a distal end, the proximal end being connected at a feed connection on one of the one or more secondary conductive elements, the distal end being an open circuit position and defining an orientation relative to the one of the one or more secondary conductive elements.

Advantageously, the antenna arrangement of the invention further comprises one or more quaternary conductive elements each having defined geometric parameters, a proximal end and a distal end, the proximal end being connected at a feed connection on one of the one or more ternary conductive elements, the distal end being an open circuit position and defining an orientation relative to the one of the one or more ternary conductive elements.

Advantageously, the antenna arrangement of the invention is tuned to radiate in two or more frequency bands, comprising one or more of an ISM band, a Wi-Fi band, a Bluetooth band, a 3G band, a LTE band and a 5G band.

The invention further discloses a method of designing an antenna arrangement comprising: defining a primary conductive element with determined geometric parameters, the primary conductive element having a proximal end and a distal end, the proximal end being connected at a feed line, the distal end being an open circuit position, the primary conductive element defining a first plurality of resonating frequencies; defining one or more secondary conductive elements, each having determined geometric parameters, a proximal end and a distal end, the proximal end being connected at a feed connection on the primary conductive element, the distal end being an open circuit position and defining an orientation relative to the primary conductive element, the one or more secondary conductive elements generating a second plurality of resonating frequencies; wherein the geometric parameters of the primary conductive element and of the one or more secondary conductive elements are determined in such a way that the frequencies in the second plurality of resonating frequencies each satisfy a condition of resonance at the feed line, the condition of resonance being determined by a sequence of combinations of input susceptances of a segment of the primary conductive element and of one of the one or more secondary conductive elements, each combination being generated at the feed connection of the said one of the one or more secondary conductive elements on the primary conductive element, a segment of the primary conductive element connecting one of its distal end or a feed connection of another of the one or more secondary conductive elements to the one of the one or more secondary elements, the sequence starting from the distal end of the primary conductive element and ending at its proximal end.

Advantageously, the one or more secondary conductive elements are iteratively added at defined locations to the primary conductive element so as to match a specification of the antenna arrangement comprising the second plurality of predefined frequencies.

Advantageously, the one or more secondary conductive elements that are added to match the specification of the antenna arrangement are further defined to match a specified bandwidth for at least one or more frequencies in the second plurality of predefined frequencies.

Advantageously, the one or more secondary conductive elements that are added to match a specification are further defined to match a form factor of the antenna arrangement.

Advantageously, the one or more secondary elements are drawn from a database of predefined elements.

Advantageously, the predefined elements have been generated by using one or more of a graphical calculation based on Smith Charts, an analytical computation, a simulation tool or a model.

Advantageously, the matching the specification is performed by using one or more of a graphical calculation based on Smith Charts, an analytical computation, a simulation tool or a model.

Advantageously, the matching the specification if further performed by optimizing a cost function.

The antenna arrangement of the invention offers the advantage of providing a plurality of resonating frequencies on a very wide frequency domain, with controlled values and controlled bandwidths.

The antenna arrangement of the invention may be compact, allowing its integration in small volumes or reduced surfaces.

The antenna arrangement of the invention is advantageously simple to design, notably when tuning at least two radiating frequencies, but possibly more, to desired values, taking into account the impact of the environment of the antenna arrangement, notably the ground plane, the relative positioning of the first and second main conductive elements and of secondary conductive elements (or "leaves") that have an electromagnetic impact on its electrical performance.

The antenna arrangement of the invention is easy to manufacture and thus has a very low cost.

Also, the antenna arrangement of the invention is very easy to connect either in an orthogonal configuration or in a coplanar configuration to a RF Printed Circuit Board (PCB).

In some optional embodiments, the bandwidths of a fundamental radiating frequency or of higher order modes may be controlled, taking into account a target matching level, so as to guarantee a minimum quality of service at these controlled frequencies to transmit video or other content that need a high throughput.

According to the invention, a plurality of design tools is provided that allow to find graphically, analytically or numerically (or using a combination of the three) the possible design parameters that match the specification.

BRIEF DESCRIPTION OF THE DRAWINGS

The invention and its advantages will be better understood upon reading the following detailed description of a particular embodiment, given purely by way of non-limiting example, this description being made with reference to the accompanying drawings in which:

FIGS. 6*a*, 6*b*, 6*c*, 6*d*, 6*e*, 6*f* and 6*g* represent examples of assemblies of antenna elements according to some embodiments of the invention;

DETAILED DESCRIPTION

Figure 1A:
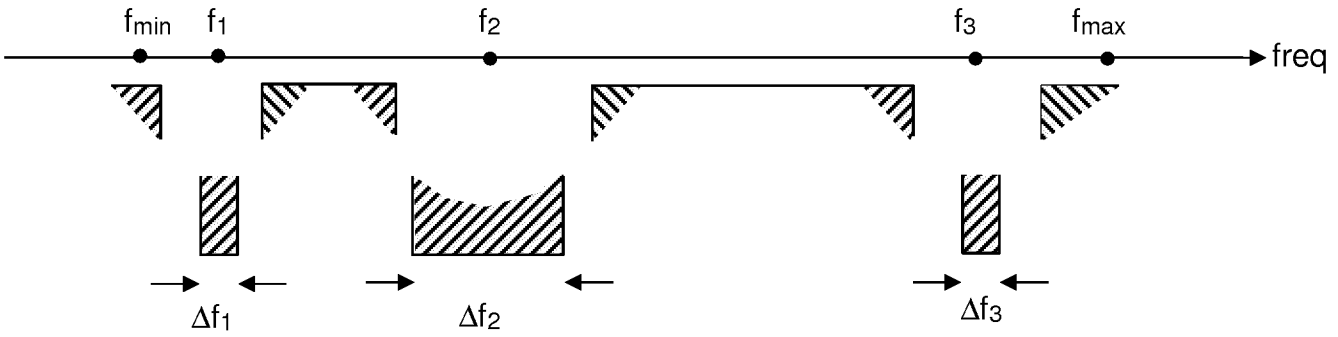
FIGS. 1*a* and 1*b* schematically represent a specification of an antenna as currently used.
Figure 1B:
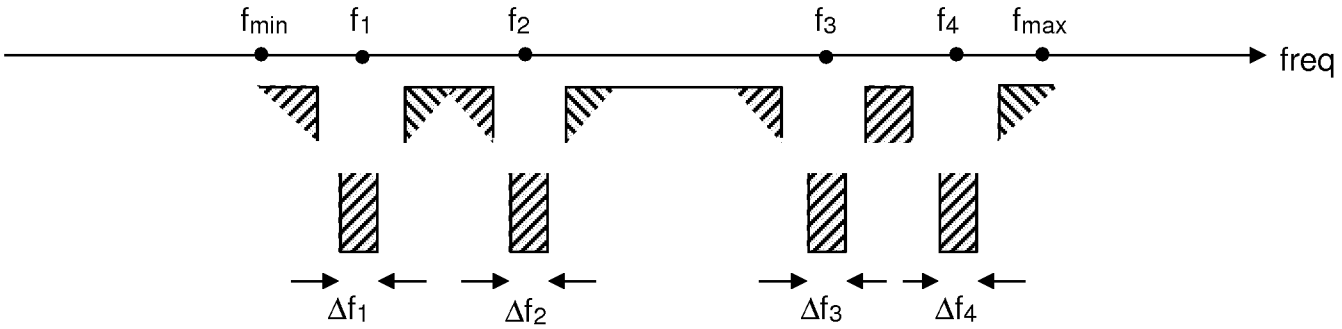

FIGS. 1*a* and 1*b* schematically represent a specification of an antenna.

The problem to be solved by a designer of an antenna arrangement is to define the various elements of the antenna arrangement that allow matching the performance criteria of the technical specification. Typically, the performance criteria will comprise:

- a number n of transmit/receive channels having center frequencies within a defined range $[f_{min}, f_{max}]$;
- the values $f_i$ of these center frequencies, $\{f_i \in [f_{min}, f_{max}], i \in \{1, \ldots, n\}\}$;
- the values of the specified bandwidths around these centre frequencies, $\{\Delta f_i, i \in \{1, \ldots, n\}\}$.

FIGS. 1*a* and 1*b* illustrate the frequency responses of the antenna arrangement to be designed at a specified matching level.

FIG. 1*a* illustrates an example with three different channels, with three centre frequencies $f_1$, $f_2$, $f_3$. In this example, the channel with center frequency $f_1$ and the channel with centre frequency $f_3$ have narrow bandwidths, while the channel with center frequency $f_2$ has a wide bandwidth.

FIG. 1*b* illustrates another example with four different channels, with four centre frequencies $f_1$, $f_2$, $f_3$, $f_4$ covering approximately about the same range of frequencies, the four channels all having rather narrow bandwidths.

There will generally be a plurality of solutions that will fulfil the specified requirements, so that other constraints may be added.

For instance, the specification of an antenna may be defined by radiating frequencies with defined bandwidths at a specified matching level and their radiation patterns at these frequencies. The radiation patterns define the gain that the antenna should achieve in each direction of space and corresponding Signal to Noise Ratio (SNR) for a radio link using the antenna.

Some constraints may also be defined in terms of number of elements in the antenna arrangement, in terms of dimensions and/or weight.

Thanks to the invention, it is possible to offer to the designer of an antenna, arrangement tools that allow designing the arrangement by assembling pre-defined elements that have predefined resonating modes and whose behaviour when assembled is known.

Therefore, according to the invention, a set of rules are defined to efficiently assemble the elements to match the specification.

Figure 2:
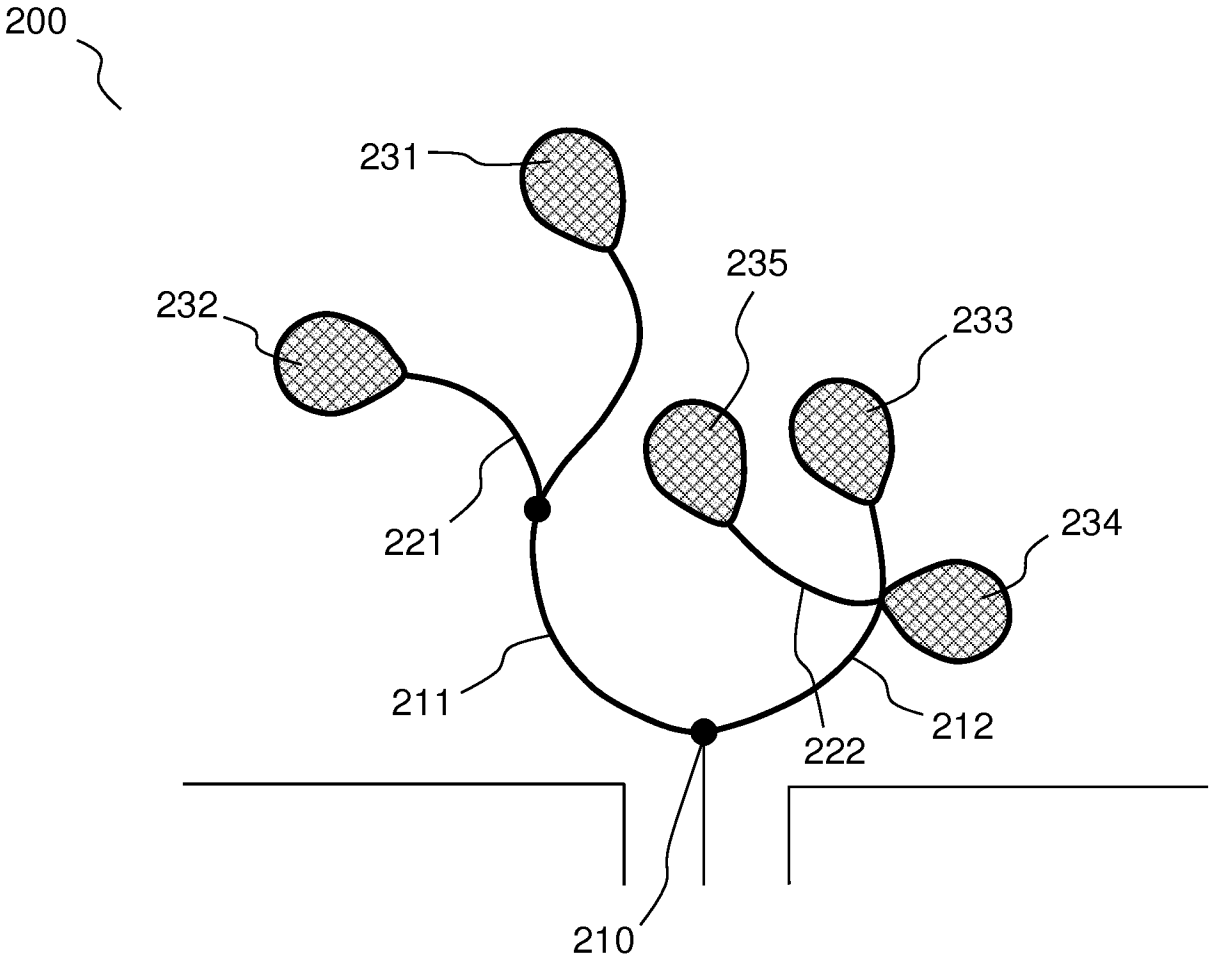
FIG. 2 displays an antenna arrangement built from a number of antenna elements according to some embodiments of the invention.

FIG. 2 displays an antenna arrangement built from a number of antenna elements according to some embodiments of the invention.

The antenna arrangement 200 has a main trunk, MT, 211, that is connected at the feed line, 210, of the arrangement. A number of secondary trunks $\{ST_k\}$, may also be provisioned. The trunks have a fundamental mode that is defined by their length. They may have different form factors, as explained below. In the case illustrated on the figure, there is only one Secondary Trunk, $ST_1$, 212. By definition, all Secondary Trunks are connected to the feed line, 210. The main advantage of an ST is that its resonating modes may be added to the antenna arrangement without impacting the resonating modes of the other antenna elements in the antenna arrangement. It should be noted that the number of STs that may be connected to an MT is limited, the limitation being contingent upon the form factor of the main trunk and the type, number, form factor and connection points of other elements borne by the said main trunk, MT.

An MT or an ST may bear a number of branches $\{B_j\}$. A branch allows adding new resonating modes, but this addition modifies some of the resonating modes of the other antenna elements in the antenna arrangement, unless the connection of the added element is at the feed line 210 of the antenna. In the exemplary antenna arrangement of FIG. 2, there is a first branch, $B_1$, 221, that is attached to the main trunk 211 and a second branch, $B_2$, 222, that is attached to the secondary trunk 212. The length of a branch and its form factor also define the resonating frequencies of this antenna element. The locations where the branches are attached to the trunks are selected through a method that is discussed further down in the description.

Then, leaves $\{L_i\}$ may be added to a trunk (main or secondary) or to a branch to adjust one or more of the centre frequencies of the resonating modes (fundamental or higher orders). In the example illustrated on FIG. 2, there is one leaf, $L_1$, 231, attached directly to the Main Trunk, 211. Two leaves, $L_3$, 233, $L_4$, 234, are attached directly to the Secondary Trunk, 212. There are also two leaves, $L_2$, 232, $L_5$, 235, attached respectively to branches 221, 222. The geometries, form factors, dimensions and orientations of the leaves define the impact that they will have on the resonating modes of the antenna element to which they are attached. Their positions define both the affected resonating modes (fundamental or higher orders) and the amount of the shift in resonating frequency that is imparted by the leaf.

A person of ordinary skill in the art of antenna design will therefore be in a position to use various kinds of elements defined according to the invention. The invention also provides this person with a set of rules to select the adequate elements and position them in the structure of the antenna arrangement to be designed.

FIGS. 3*a*, 3*b*, 3*c*, 3*d* and 3*e* represent different types of antenna elements according to some embodiments of the invention and some of their use cases.

An antenna arrangement according to the invention comprises antenna elements that are of a type exemplified on one of FIG. 3*a*, 3*b*, 3*c* or 3*d*.

Figure 3A:
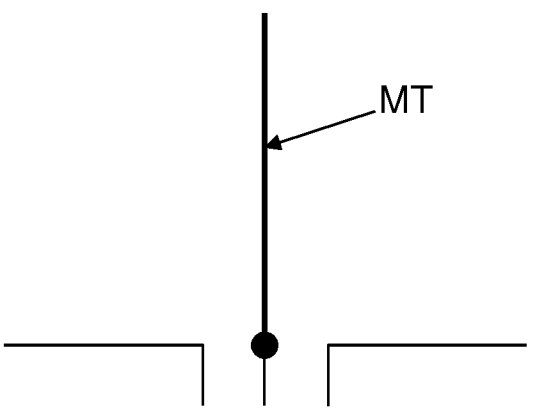
FIGS. 3*a*, 3*b*, 3*c*, 3*d* and 3*e* represent different types of antenna elements according to some embodiments of the invention and some of their use cases.

FIG. 3*a* schematically represents a Main Trunk, MT. A Main Trunk is directly connected to the feed line of the antenna arrangement with a connection at this point that is orthogonal or not to the ground plane of the antenna arrangement. A Main Trunk is a monopole antenna that has a length $\ell$ equal to $\lambda/4$ where $\lambda$ is the wavelength of the fundamental mode of this antenna element with $\lambda=c/f$ where f is the radiating frequency at the fundamental mode and c the speed of light in vacuum.

The Main Trunk, MT, is the basic radiating element of the antenna arrangement. It generates within the range of frequencies $[f_{min},f_{max}]$ a number $n_{MT}$ of radiating modes (fundamental and higher orders) at defined frequencies, each of the radiating modes defining a transmit/receive communication channel. Preferably, the fundamental mode of MT will be associated with the frequency that is the closest to $f_{min}$, which is the lowest frequency of interest. But some other embodiments are also possible.

Figure 3B:
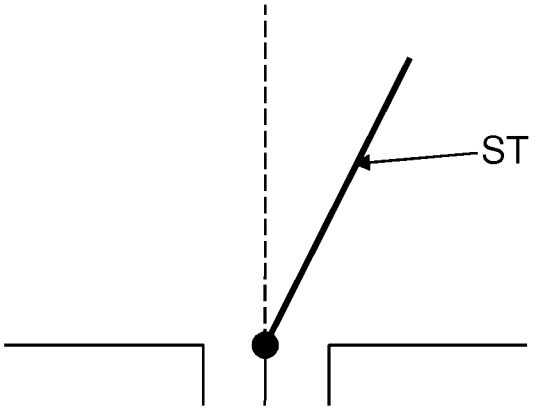

FIG. 3*b* schematically represents a Secondary Trunk, ST. A Secondary Trunk is directly connected to the feed line of the antenna arrangement with a connection at this point that is not orthogonal to the ground plane of the antenna arrangement. In some embodiments where MT is not orthogonal to the ground plane, an ST may itself be positioned orthogonally to the ground plane. A Secondary Trunk will have a length $\ell'$ defining another resonating frequency f' of the antenna arrangement, with $\ell'=\lambda'/4$ and $\lambda'=f'$. As explained in more details below, the Secondary Trunk adds a number of new resonating frequencies to the antenna arrangement within the range of frequencies $[f_{min},f_{max}]$, without impacting the resonating frequencies defined by the Main Trunk (provided that the elements remain in a relative position to one another that does not create electromagnetic interference at this frequency).

Secondary Trunks are therefore advantageously used to add new transmit/receive communication channels to the antenna arrangement.

Figure 3C:
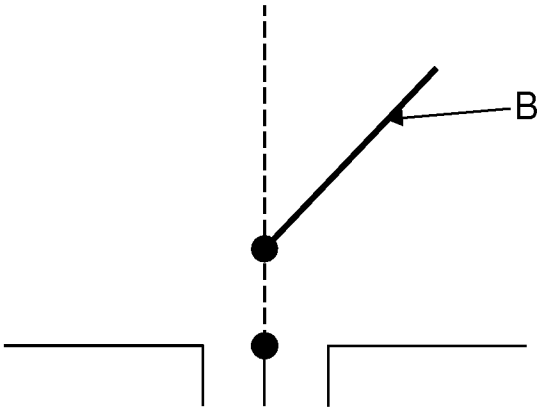

FIG. 3*c* schematically represents a Branch, B. A Branch adds new radiating frequencies and modifies some of the radiating modes of the pre-existing antenna arrangement (the ones—if any—for which the point of connection of the Branch is not a Cold Spot). Using branches is more complex than using trunks, or leaves, but it provides this advantage to add some more options to reach the specifications of an antenna arrangement, especially when a high number of frequencies are needed and the antenna needs to be very compact.

Figure 3D:
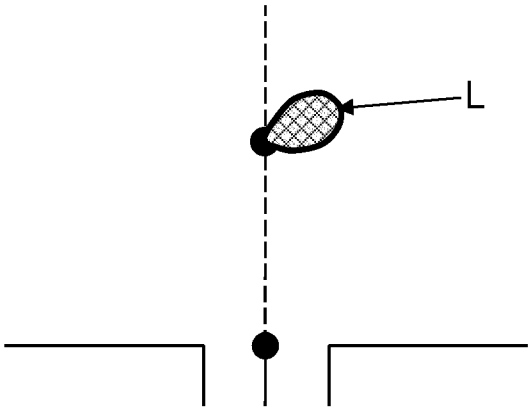

FIG. 3*d* schematically represents a Leaf, L. A Leaf will typically have a main dimension that is smaller than $\lambda^{(j)}/4$, where $\lambda^{(j)}=c/f^{(j)}$, $\{f^{(j)}\}$ being the frequencies of the fundamental mode and of a number P of higher order modes of the antenna element to which the leaf is attached. The number P is chosen so that $f^{(P)}$ is equal to the maximum frequency in the list of target frequencies in the specification that are generated by this antenna element. As an example, let's take as the lower frequency of interest the center frequency $f^{(0)}$ of the E5 Galileo navigation signal, 1191.795 MHz, a second higher frequency of interest being a Wi-Fi channel of the 2.4 GHz band that has a center frequency of 2472 MHz and a third frequency of interest being a Wi-Fi channel of the 5 GHz band that has a center frequency of 5700 MHz. The E5 frequency may be obtained with a Trunk with a length $\ell$ of about 6.3 cm that has a fundamental resonating mode at the E5 frequency:

$$\ell = \frac{c}{4\times f} = \frac{3\times 10^8}{4\times 11{,}9\times 10^8}.$$

This Trunk has two higher order resonating modes at frequencies $f^{(1)}=3\times f^{(0)}=3575.385$ MHz and $f^{(2)}=5\times f^{(0)}=5958.975$ MHz. It is possible to add to the Trunk a first Leaf that will be designed and positioned so as to shift the first higher order resonating mode of the antenna arrangement from 3575.385 MHz down to 2472 MHz. It is also possible to add to the Trunk a second Leaf that will be designed and positioned so as to shift the second higher order resonating mode of the antenna arrangement from 5958.975 MHz down to 5700 MHz. In this example, the maximum length of the Leaf is defined by the second higher order resonating mode and is equal to 1.26 cm ($\ell_{max}=c/4\times f^{(2)}$)

A Leaf is a non-resonating element that is mostly used to control the frequencies of the radiating modes of a Main Trunk, a Secondary Trunk or a Branch, to which it is attached.

Each of the antenna elements MT, ST, B and L as defined above, are further defined by intrinsic parameters and extrinsic parameters.

The intrinsic parameters comprise:

its geometry, G, i.e. whether it is a one-dimensional (1D) element, a two-dimensional (2D) element or a three-dimensional (3D) element;

its form factor, F, to be defined for each geometry;

its dimensions, D, the number of characteristic dimensions depending on the geometry and on the form factor.

The extrinsic parameters comprise:

its orientation/positioning, O, relative to the element of the antenna arrangement to which it is attached; for instance, a Branch may be positioned perpendicularly to a Main Trunk or a Secondary Trunk so as to minimize coupling effects between the two antenna elements; it may also be positioned at an angle different from 90°;

its position, P, on the element of the antenna arrangement to which it is attached; for instance, Hot Spots are defined at nodes of current (or an Open Circuit position, such has the open end of an MT, ST or B) on a radiating element; a Leaf positioned at a Hot Spot on a Main Trunk or a Secondary Trunk, has an effect of shifting the frequency of the fundamental mode or of a higher order mode of the trunk that is maximal, all other parameters (O, G, F, D) being constant.

Figure 3E:
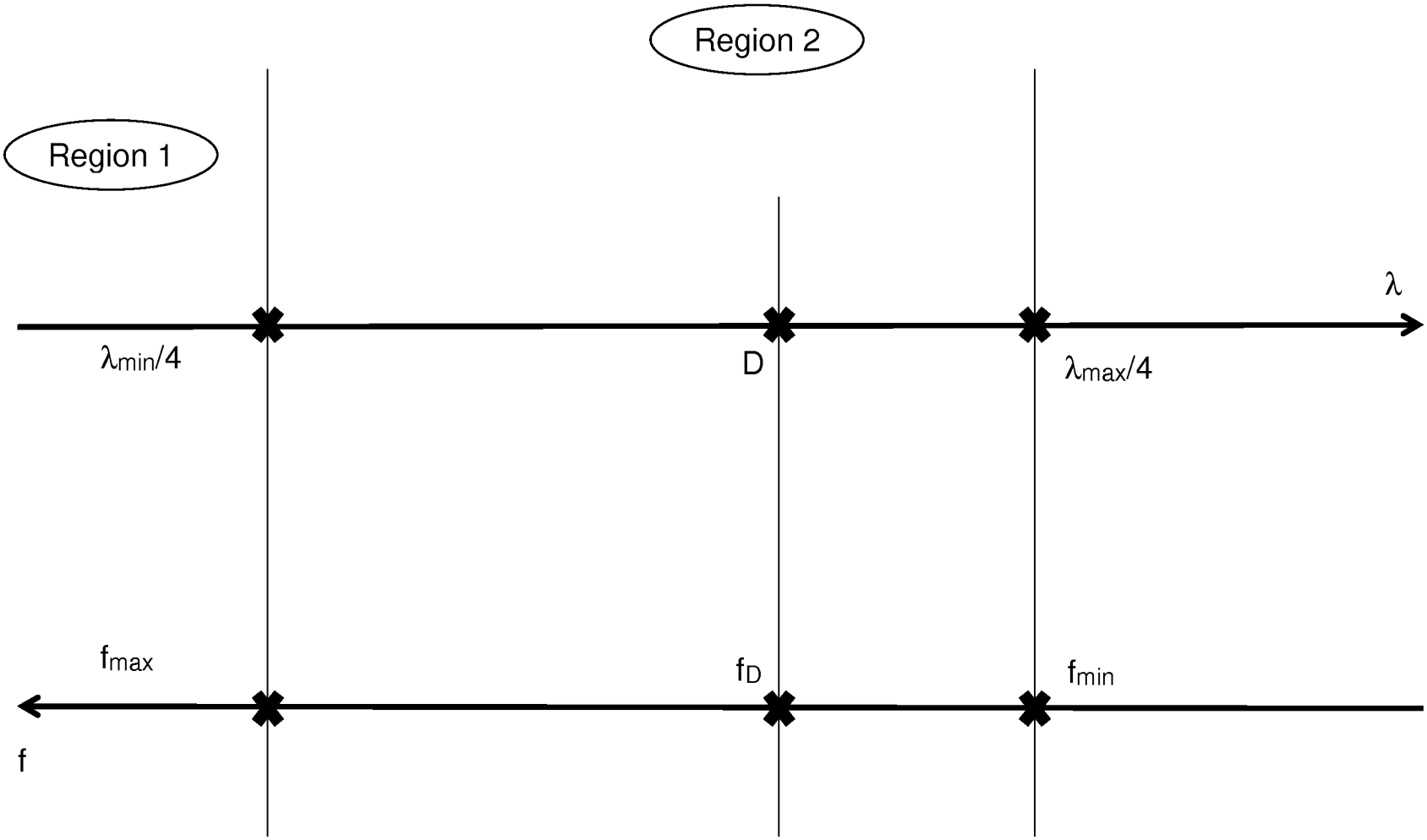

FIG. 3*e* illustrates a number of use cases of an antenna element according to the invention.

According to the invention, an antenna element of the type depicted on one of FIG. 3*b*, 3*c* or 3*d*, and described in relation thereto, may be used to generate different types of effects depending on its dimension D. If the specification defines a set of values of resonating frequencies that are included in an interval $[f_{min},f_{max}]$, we can define a corresponding interval of dimensions within the wavelengths interval $[\lambda_{min}/4, \lambda_{max}/4]$ where $\lambda_{max}=c/f_{min}$ and $\lambda_{min}=c/f_{max}$.

If the antenna element has a dimension D that is lower than $\lambda_{min}/4$ (Region 1 on FIG. 3*e*), the antenna element will have the structure and the function of a Leaf, will not generate any new resonating frequency and will have the effect of shifting the value of one or more of the resonating frequencies in the interval $[f_{min},f_{max}]$, the magnitude of the shift depending on the susceptance of the antenna element and on its position on the MT, ST or B to which it is attached.

If the antenna element has a dimension D that is greater than $\lambda_{min}/4$ and lower than $\lambda_{max}/4$ (Region 2 on FIG. 3*e*), for some values of resonating frequencies, the antenna element will have the function of a Branch or a Secondary Trunk, depending on whether it is positioned at the feed line of the Main Trunk or at another position thereon. It will have the potential of generating one or more new resonating frequencies in the interval $[f_D,f_{max}]$, where $f_D=c/4\times D$. Depending on whether these potential new resonating frequencies are separated or not (at a specified matching level) from the pre-existing resonating frequencies, they will either be actual new resonating frequencies or generate an enlarged bandwidth around the pre-existing resonating frequencies in this interval. At the same time, the antenna element that is structurally an ST or a Branch will behave as a Leaf in the whole interval $[f_{min},f_{max}]$ and shift some of the pre-existing resonating frequencies in this interval, the magnitude of the shift depending on the susceptance of the antenna element and on its position on the MT, ST or B to which it is attached.

FIGS. 4*a*, 4*b*, 4*c*, 4*d*, 4*e*, 4*f* and 4*g* represent examples of antenna elements of different shapes according to some embodiments of the invention.

The figures illustrate some of the possible embodiments of the invention in relation to the intrinsic parameters of a Main Trunk or a Secondary Trunk.

Figure 4A:
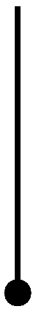
FIGS. 4*a*, 4*b*, 4*c*, 4*d*, 4*e*, 4*f* and 4*g* represent examples of antenna elements of different shapes according to some embodiments of the invention.
Figure 4B:
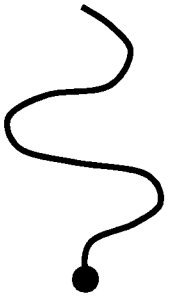
Figure 4C:
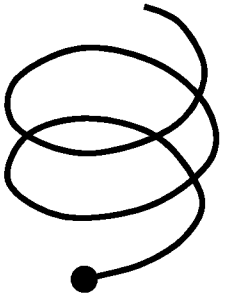

FIGS. 4*a*, 4*b* and 4*c* illustrate embodiments of the invention wherein the Main and/or Secondary Trunk is/are of a wire type, in a 1D, 2D or 3D geometry.

On FIG. 4*a*, a trunk with a 1D geometry is represented. Its form factor F is rectilinear. Its dimension D can be adapted to the frequencies that are needed to generate the transmit/receive communication channels of the specification of the antenna arrangement.

On FIG. 4*b*, a trunk with a 2D geometry is represented. Its form factor F is sinusoidal. Its dimension D is the full length of the antenna element and is also adapted to generate the transmit/receive communication channels of the specification of the antenna arrangement. Such an element is more compact than the antenna element of FIG. 4*a* for a same dimension D.

On FIG. 4*c*, a trunk with a 3D geometry is represented. Its form factor F is helicoIdal. Its dimension D is the full length of the antenna element and is also adapted to generate the transmit/receive communication channels of the specification of the antenna arrangement. Such an element is more compact than the antenna element of FIGS. 4*a* and 4*b* for a same dimension D.

Figure 4D:
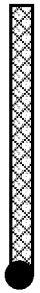

On FIG. 4*d*, a trunk with a geometry which is close to a 1D geometry is represented. It is of a thin ribbon type and its form factor F is rectilinear. Its dimension D can be adapted to the frequencies that are needed to generate the transmit/receive communication channels of the specification of the antenna arrangement.

Figure 4E:
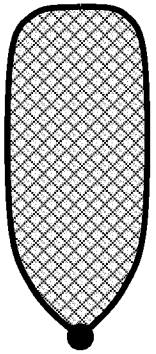

On FIG. 4*e*, a trunk with a 2D geometry is represented. Its form factor F is close to a rectangular surface with a tapered shape at its base, the tapered shape base enabling an improved control of the matching level of the antenna. Its larger dimension D is adapted to generate the transmit/receive communication channels of the specification of the antenna arrangement. The smaller dimension, perpendicular to the larger dimension D, has a value that is adapted to adjust the bandwidth around the centre frequencies of the useful resonating modes of the trunk: increasing this dimension increases the bandwidth. This is due to the fact that the impedance (or admittance) of the antenna element varies more slowly around the centre frequency compared with an antenna that has a linear form factor, such as a wire.

Figure 4F:
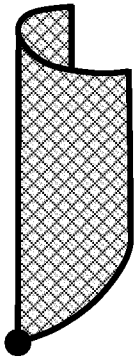

On FIG. 4*f*, a trunk with a 3D geometry is represented. Its form factor F is a semi-cylindrical surface with a tapered shape at its base. Its larger dimension D is adapted to generate the transmit/receive communication channels of the specification of the antenna arrangement. Such an element has a smaller dimension that is adapted to adjust the bandwidth around the centre frequency of the useful modes of the trunk but is more compact than the antenna element of FIG. 4*e* for a same dimension D.

Figure 4G:
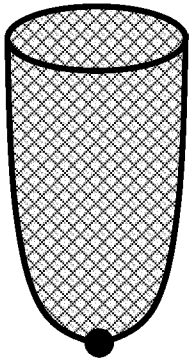

On FIG. 4*g*, a trunk with a 3D geometry is represented. Its form factor F is a cylindrical volume with a tapered shape at its base. This trunk may define the same frequencies and bandwidths than the semi-cylindrical trunk of FIG. 4*f*. The radiation pattern determined by this cylindrical element will be more homogenous and have less spatial diversity than the radiation pattern determined by the semi-cylindrical trunk of FIG. 4*f*.

The antenna elements depicted on FIGS. 4*a*, 4*b*, 4*c*, 4*d*, 4*e*, 4*f* and 4*g* are only exemplary embodiments of antenna elements according to the invention. Variants of different form factors may be derived from these by a person of ordinary skill without exercising an inventive activity and without departing from the scope of the invention.

The same geometries and form factors may also be applied to variants of Branches or Leaves.

FIGS. 5*a*, 5*b*, 5*c* and 5*d* represent examples of leaf antenna elements of different form factors according to some embodiments of the invention.

Figure 5A:
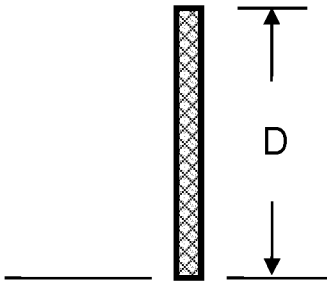
FIGS. 5*a*, 5*b*, 5*c* and 5*d* represent examples of leaf antenna elements of different form factors according to some embodiments of the invention.

On FIG. 5*a* is depicted an example of a 1D leaf with a rectilinear form factor. In this example, the width of the leaf is 1 mm. The length D is 5 mm. It is positioned perpendicular to a Trunk or a Branch (O=90°.

According to the invention, the value of the susceptance B (in Siemens, S) seen at the input of this antenna element is calculated to be used in further calculations of the impact of the antenna element on the frequencies and bandwidths of a resonating element that incorporates this antenna element.

The calculation uses the following canonical definitions:
R being the resistance seen at the input of the antenna element (in Ohms, (Ω));
X being the reactance seen at the input of the antenna element (in Ohms, (Ω));
Z being the impedance seen at the input of the antenna element (in Ohms, (Ω));
G being the conductance seen at the input of the antenna element (in Siemens, S);
Y being the admittance seen at the input of the antenna element (in Siemens, S).

The equations to calculate the susceptance are then the following:

$$Z = R + jX \quad \text{(Eq. 1)}$$

$$Y = G + jB \quad \text{(Eq. 2)}$$

$$G = \frac{R}{R^2 + X^2} \quad \text{(Eq. 3)}$$

$$B = \frac{-X}{R^2 + X^2} \quad \text{(Eq. 4)}$$

Then, resolving the equations above for the values of the parameters of the antenna element of FIG. 5*a* for finding B allows generating the values of B.

Alternatively, it is possible to obtain experimentally or by simulation the table below for a range of frequencies f:

| f (GHz) | R (Ω) | X (Ω) | G(mS) | B (mS) |
|---|---|---|---|---|
| 1 | 2 | −1210 | 0.001 | 0.826 |
| 1.5 | 1 | −870 | 0.001 | 1.149 |
| 2 | 0 | −650 | 0.000 | 1.538 |
| 2.5 | 1 | −493 | 0.004 | 2.028 |
| 3 | 4 | −382 | 0.027 | 2.618 |
| 3.5 | 11 | −316 | 0.110 | 3.161 |
| 4 | 17 | −266 | 0.239 | 3.744 |
| 4.5 | 14 | −228 | 0.268 | 4.369 |
| 5 | 10 | −208 | 0.231 | 4.797 |
| 5.5 | 12 | −197 | 0.308 | 5.057 |
| 6 | 19 | −188 | 0.532 | 5.265 |

Figure 5B:
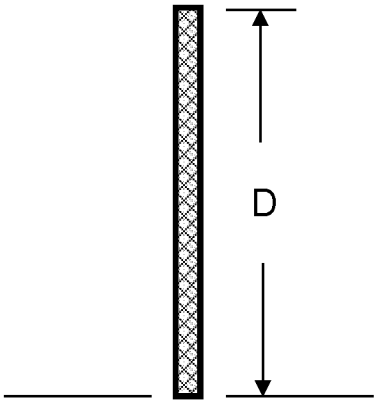

On FIG. 5*b* is depicted an example of a 1D leaf with a rectilinear form factor. In this example, the width of the leaf is 1 mm. The length D is 7.5 mm. It is positioned perpendicular to a Trunk or a Branch (O=90°).

The table below displays the measurements of the parameters above for various frequencies; alternatively, these parameters can be obtained by direct calculation using Equations 1 to 4:

| f (GHz) | R (Ω) | X (Ω) | G(mS) | B (mS) |
|---|---|---|---|---|
| 1 | 2 | −928 | 0.002 | 1.078 |
| 1.5 | 1 | −674 | 0.002 | 1.484 |
| 2 | 2 | −511 | 0.008 | 1.957 |
| 2.5 | 9 | −389 | 0.059 | 2.569 |
| 3 | 21 | −288 | 0.252 | 3.454 |
| 3.5 | 30 | −220 | 0.608 | 4.462 |
| 4 | 33 | −167 | 1.139 | 5.763 |
| 4.5 | 27 | −129 | 1.554 | 7.427 |
| 5 | 22 | −105 | 1.911 | 9.123 |
| 5.5 | 26 | −86 | 3.221 | 10.654 |
| 6 | 32 | −70 | 5.402 | 11.816 |

Figure 5C:
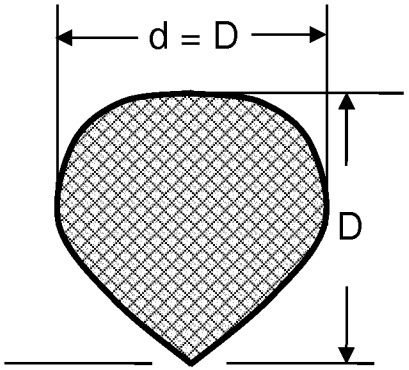

On FIG. 5*c* is depicted an example of a 2D leaf with a "water drop" form factor. In this example, the width and the length of the leaf equal 5 mm. It is positioned perpendicular to a Trunk or a Branch (O=90°).

The table below displays the measurements of the parameters above for various frequencies; alternatively, these parameters can be obtained by direct calculation using Equations 1 to 4:

| f (GHz) | R (Ω) | X (Ω) | G(mS) | B (mS) |
|---|---|---|---|---|
| 1 | 2 | −638 | 0.005 | 1.567 |
| 1.5 | 0 | −495 | 0.000 | 2.020 |
| 2 | 1 | −409 | 0.006 | 2.445 |
| 2.5 | 2 | −340 | 0.017 | 2.941 |
| 3 | 15 | −275 | 0.198 | 3.626 |
| 3.5 | 28 | −221 | 0.564 | 4.453 |
| 4 | 35 | −171 | 1.149 | 5.613 |
| 4.5 | 28 | −132 | 1.538 | 7.250 |
| 5 | 21 | −107 | 1.766 | 8.999 |
| 5.5 | 21 | −90 | 2.459 | 10.537 |
| 6 | 25 | −77 | 3.814 | 11.749 |

Figure 5D:
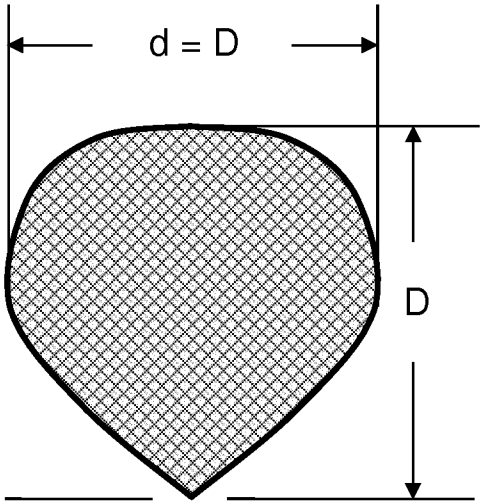

On FIG. 5*d* is depicted an example of a 2D leaf with a "water drop" form factor. In this example, the width and the length of the leaf equal 7.5 mm. It is positioned perpendicular to a Trunk or a Branch (O=90°).

The table below displays the measurements of the parameters above for various frequencies; alternatively, these parameters can be obtained by direct calculation using Equations 1 to 4:

| f (GHz) | R (Ω) | X (Ω) | G(mS) | B (mS) |
|---|---|---|---|---|
| 1 | 5 | −426 | 0.028 | 2.347 |
| 1.5 | 2 | −330 | 0.018 | 3.030 |
| 2 | 5 | −266 | 0.071 | 3.758 |
| 2.5 | 12 | −213 | 0.264 | 4.680 |
| 3 | 22 | −163 | 0.813 | 6.025 |
| 3.5 | 32 | −125 | 1.922 | 7.508 |
| 4 | 36 | −94 | 3.553 | 9.278 |
| 4.5 | 31 | −71 | 5.165 | 11.829 |
| 5 | 26 | −55 | 7.025 | 14.861 |
| 5.5 | 30 | −40 | 12.000 | 16.000 |
| 6 | 37 | −24 | 19.023 | 12.339 |

It is to be noted that at the higher frequencies (5,5/6 GHz), D cannot be considered to be much smaller than λ/4 since at 6 GHz, $\lambda_{freespace}$=5 cm and λ/=1.25 cm, while D=0.75 cm. Thus, the leaf begins having a resonant behavior that may generate new radiating frequencies of the antenna arrangement.

The tables above can be easily computed for other dimensions, using the formulas of equations 1 to 4 for the same form factors. These tables may be associated with the antenna elements in a library of antenna elements generated to implement the invention. Also, an electromagnetic simulation tool may be associated with the library to calculate "on-the fly", the input susceptance of the antenna elements in the library for any geometry, form factor, values of dimensions and frequencies. Alternatively, tables can be used in combination with interpolation algorithms, to calculate the values of the input susceptance for various form factors and for dimensions and frequencies that are not tabulated.

FIGS. 5*e*, 5*f*, 5*g* and 5*h* represent examples of trunk/branch antenna elements of different form factors according to some embodiments of the invention.

Figure 5F:
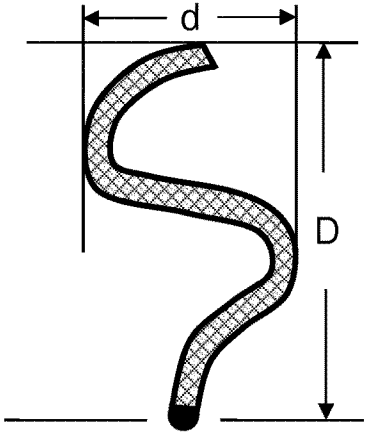
FIGS. 5*e*, 5*f*, 5*g* and 5*h* represent examples of trunk/branch antenna elements of different form factors according to some embodiments of the invention.
Figure 5H:
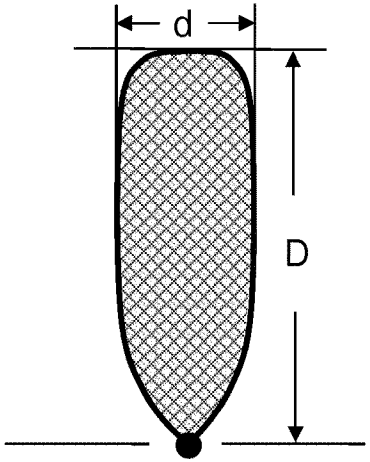
Figure 5E:
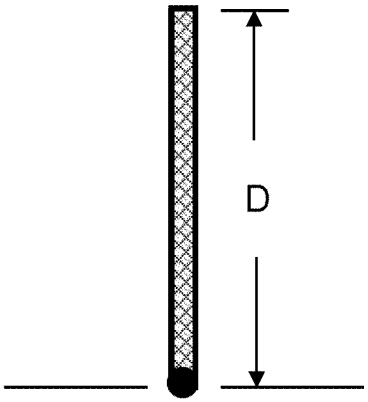

FIG. 5*e* represents an ST or a B element of a 1D geometry and a rectilinear form factor. The difference with the antenna element of FIG. 5*a*, that is a Leaf, is that its main dimension D is defined according to the rules indicated above in relation to FIG. 3*e*, i.e. the antenna element has a main dimension D that is higher than $\lambda_{min}/4$ and lower than $\lambda_{max}/4$, max creates potential new resonating frequencies in the interval $[f_D, f_{max}]$ and shifts the pre-existing resonating frequencies in the interval $[f_{min}, f_{max}]$ FIG. 5*f* represents an ST or a B element of a 2D geometry and a curvilinear form factor. There is no equivalent in the Leaf types described in FIGS. 5*a* to 5*d*.

Figure 5G:
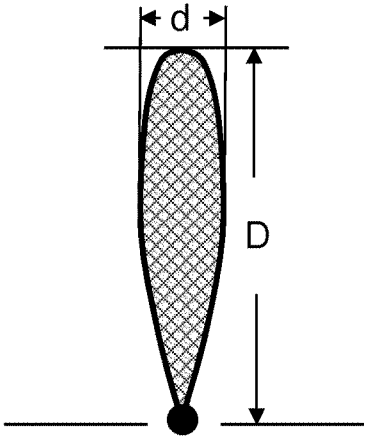

FIG. 5*g* represents an ST or a B element of a 2D geometry and a drop form factor, similar to the embodiments of FIGS. 5*c* and 5*d*.

FIG. 5*h* represents an ST or a B element of a 2D geometry and a rectangle-with-tapered-bottom form factor. There is no equivalent in the Leaf types described in FIGS. 5*a* to 5*d*.

The 2D form factors with drop or rectangle form factor allow for a better control of the bandwidths around target resonating frequency values.

A person of ordinary skill in the art would be able to generate tables similar to those commented upon in relation to FIGS. 5*a*, 5*b*, 5*c* and 5*d*. These tables may be measured values. They may be calculated using a model. They may be calculated using a Smith Chart as indicated further down in the description. These tables may be associated with descriptors of antenna elements that are stored in a database of antenna elements.

FIGS. 6*a*, 6*b*, 6*c*, 6*d*, 6*e*, 6*f* and 6*g* represent examples of assemblies of antenna elements according to some embodiments of the invention.

An antenna element of a ST, B or L type is assembled on an antenna element of a MT, ST or B type by a direct connection, through soldering for instance.

The combinations of antenna elements according to the invention are listed below:

ST on MT;

B on MT, on ST or on B;

L on MT, on ST or on B.

An MT is designated as a primary conductive element of the antenna arrangement. An ST is a secondary conductive element. A B may be a secondary conductive element when directly connected to the MT. It may also be a ternary conductive element when connected to an ST or to another B itself directly connected to the MT. It may also be a quaternary conductive element when connected to a B itself connected to a B connected to the MT, etc . . . . Likewise for an L, that will be designated as a secondary conductive element when directed connected on an MT, a ternary conductive element when connected to a B connected directly to an MT or a quaternary conductive element when connected to a B itself to a B directly connected to the MT.

The bonsai tree may be expanded iteratively by adding new levels of antenna elements (B or L) to better match the specification.

These elements may be stored in a database of discrete simple antenna elements (Trunks, Branches or Leaves). The database may also comprise assemblies of these discrete antenna elements ST with B(s) and/or L(s) directed connected thereto; B with other B(s) connected thereto, each B comprising L(s) or not, or any kind of assembly of these discrete elements with whatever number of levels in the architecture of the tree bonsai tree defined by the assembly. The susceptances of the elements and the assemblies may also be stored in the database, together with their geometric parameters.

FIG. 6*a* illustrates a simple configuration of an antenna arrangement where a Secondary Trunk, ST, is connected at the feed line of the Main Trunk, MT. ST has an orientation relative to MT that is about 45°, so that it is far enough both from MT and from the ground plane of the antenna arrangement. The ST being connected at the feed line that is a Cold Spot (i.e. a Short Circuit, associated with a peak of current) for all resonating modes of the MT, the resonating modes of the ST do not interfere with the pre-existing resonating modes of the MT and therefore add new transmit/receive communication channels to those of the MT.

FIG. 6*b* illustrates a configuration of an antenna arrangement where a Branch, B is attached to a Main Trunk, MT. The Branch has a dimension D that is determined to generate new radiating frequencies of the antenna arrangement comprising MT and B in the $[f_{min}, f_{max}]$ domain. See comments above in relation to FIG. 3*e*. A Branch will normally be positioned at a Cold Spot for one of the resonating modes of MT, so as not to modify the frequency of this resonating mode. But it will then modify the other resonating modes if the point of connexion of the Branch is not a Cold Spot for these other modes. There will be new resonating modes and the resonating modes of the antenna arrangement prior to the addition of the Branch will be modified.

We will then have:

$\{f_{i\ MT}, i \in \{1, \ldots, n\}\}$: the initial proper resonating modes of MT;

$\{f_{j\ MT+B}, j \in \{1, \ldots, m\}\}$: the new proper resonating modes of MT plus B;

$\{f'_{i\ MT}, i \in \{1, \ldots, n\}\}$: the modified proper resonating modes of MT;

$\{f'_{i\ MT}, i \in \{1, \ldots, n\}\} \cup \{f_{j\ MT+B}, j \in \{1, \ldots, m\}\}$: the proper resonating modes of the antenna arrangement comprising MT and B.

When the new frequencies are sufficiently apart from the initial frequencies, new transmit/receive communication channels may be defined. Conversely, when one or more of them are close enough to a frequency of a pre-existing resonating mode, the bandwidth around this frequency is enlarged, provided however that the matching level at a specified value exceeds a predefined threshold.

In other embodiments, the Branch B may be positioned on a ST, in an antenna arrangement that is illustrated on FIG. 6*c*, or a Branch B' may be positioned on a Branch B, as illustrated on FIG. 6*d*. In both cases, new resonating frequencies are added to the resonating frequencies that were pre-existing before the addition of the new element, creating either new channels or enlarging the bandwidth of pre-existing channels.

FIGS. 6*e*, 6*f* and 6*g* illustrate different embodiments, whereby a Leaf, L is added to a Main Trunk, MT, a Secondary Trunk, ST or a Branch, B.

A Leaf L will be considered as such when having a main dimension D lower than or equal to $\lambda^{(P)}/4$, where $\lambda^{(P)}=c/f^{(P)}$, $f^{(P)}$ being the frequency of the $P^{th}$ higher order mode of the antenna element where the Leaf L is attached and being the highest useful frequency generated by the combination of the L with an MT, an ST or a B, as explained above.

The intrinsic parameters of the Leaf (Geometry, Form Factor, Dimension) will define a first magnitude of the impact of the Leaf on the frequencies of the resonating modes of the antenna element to which the Leaf is attached. This impact will vary depending on the frequency of the resonating mode, a magnitude of the impact being defined by the input susceptance of the Leaf. Examples of this impact have been discussed above in relation to FIGS. 5*a* through 5*d*.

Also, the extrinsic parameters (Orientation, Position) of the Leaf relative to the antenna element to which it is attached will modify the impact of the Leaf on the frequencies of the resonating modes of this antenna element.

All other things being equal, the shift in frequency imparted by a Leaf to a resonating mode of the antenna element to which it is attached will be maximum when the Leaf is positioned at a Hot Spot of the antenna element, i.e. a node of current of the antenna element or an Open Circuit. Conversely, the shift in frequency will be minimum when the Leaf is positioned at a Cold Spot of the antenna element, i.e. a maximum of current of the antenna element or a Short Circuit. Intermediate areas may easily be defined, that may be defined as "Tepid" Spots.

When the main electromagnetic parameters (input susceptance, input admittance for instance) of an antenna element have been defined as a function of the intrinsic parameters (G, F, D) and of the extrinsic parameter (Orientation), it is possible to define the impact on the resonating frequencies of the antenna arrangement by resolving either graphically, analytically or by simulation or modelling the equations that define the way in which admittances/susceptances of the combination of antenna elements are compounded. Conversely, finding the parameters (extrinsic and intrinsic) of a combination of antenna elements that will define an antenna arrangement that will comply with a specification is equivalent to solving the inverse problem. This can also be done graphically, analytically or by simulation or modelling, as will be explained further down in the description.

FIGS. 7*a*, 7*b*, 7*c*, 7*d*, 7*e* and 7*f* represent examples of assemblies of antenna elements of different shapes according to some embodiments of the invention.

These figures represent various examples of assemblies comprising a first antenna element of an MT type and a second antenna element of an ST or a B type. Nevertheless, the second antenna element may very well be of a L type, the difference being in the dimension D relative to the frequency of the highest frequency useful mode of the first antenna element, useful meaning that they allow defining frequencies that are targeted according to the specification of the antenna.

Figure 7A:
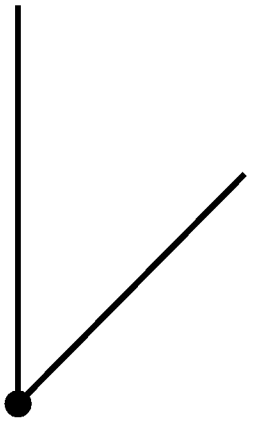
FIGS. 7*a*, 7*b*, 7*c*, 7*d*, 7*e* and 7*f* represent examples of assemblies of antenna elements of different shapes according to some embodiments of the invention.
Figure 7B:
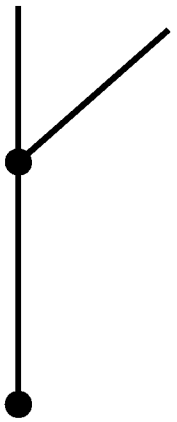

FIGS. 7*a* and 7*b* display antenna arrangements that are similar to those of FIGS. 6*a* and 6*b*, except that they may as well comprise a Leaf L as a substitute to the element of a ST type of FIG. 6*a* and to the element of a B type of FIG. 6*b*. The first antenna element of an MT type has a 1D geometry.

Figure 7C:
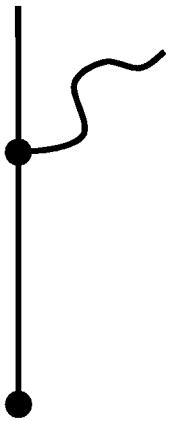
Figure 7D:
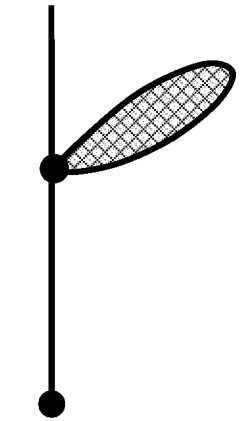

FIGS. 7*c* and 7*d* represent antenna elements of a B type or of a L type, that are 2D elements, attached to elements of an MT type having a 1 D geometry.

Figure 7E:
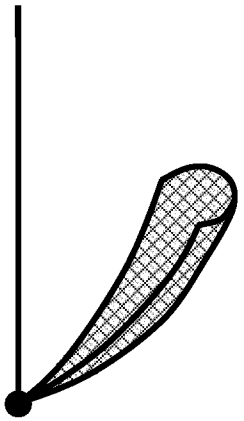

FIG. 7*e* represents an antenna element of an ST type or of an L type, that is a 3D element, attached to an element of an MT type having a 1D geometry.

Figure 7F:
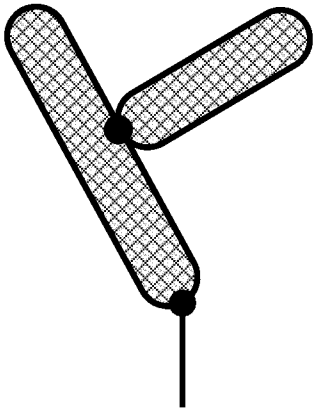

FIG. 7*f* represents a 2D antenna element of a B type or an L type attached to a 2D antenna element of an MT type.

Many other combinations are possible, allowing to match the specifications of the antenna arrangement.

Figure 8:
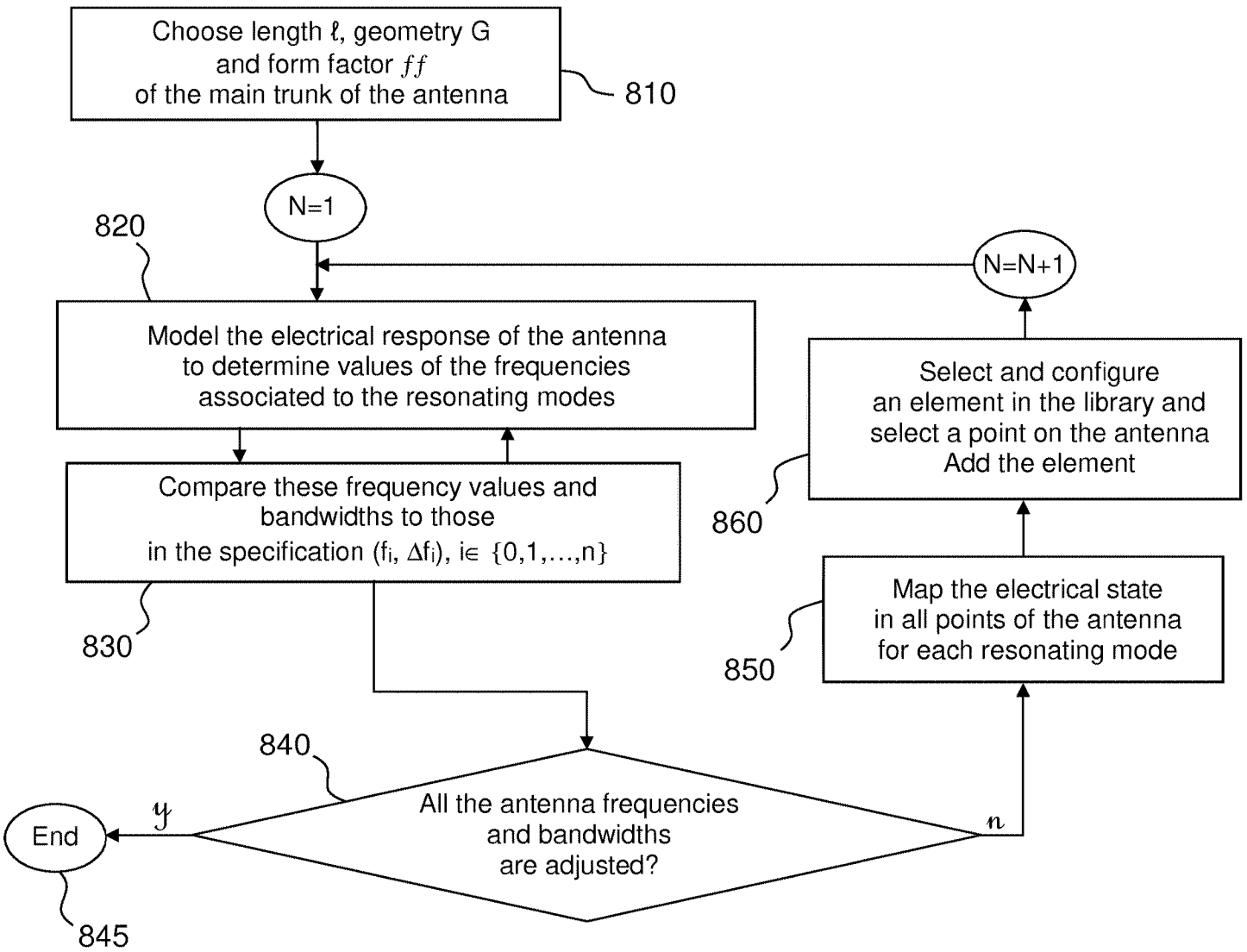
FIG. 8 is a flow chart illustrating a design method of an antenna arrangement according to some embodiments of the invention.

FIG. 8 is a flow chart illustrating a design method of an antenna arrangement according to some embodiments of the invention.

A specification of an antenna arrangement comprises one or more of:

- a list of frequency values $\{f_i, i \in \{1, \ldots, n\}\}$ at which the antenna arrangement resonates and thus is configured to transmit/receive electromagnetic signals;
- bandwidths $\{BW_i, i \in \{1, \ldots n\}\}$ associated with these frequencies at a defined matching level;
- a form factor and a geometry that the antenna arrangement should fit in.

Some other specifications may be added, depending, at least partially, on the antenna arrangement, like the shape of the radiating beam, or depending mostly on other elements of the T/R processing chain, like power level or SNR. But these specifications are not dealt with here, while the invention applies to any kind of specification of antenna arrangement comprising such requirements.

For designing an antenna arrangement based on a main antenna element that is a monopole fulfilling the specification, the invention procures notably a method that comprises choosing a Main Trunk as a first element for the antenna arrangement, the Main Trunk having a length $\ell$ and a form factor ff and a geometry g (step 810).

At a first order, the length of the Main Trunk should be such as $\ell$ where $\lambda=c/f$, f being a resonating frequency of one of the resonating modes of the main antenna element. In an advantageous embodiment, f is selected to be the lowest frequency value in the list of frequency values and the resonating frequency of the fundamental mode.

The form factor and geometry of the trunk may be defined as a function of the compactness that has to be reached for a defined target frequency. If a maximum dimension of the antenna element is set to a value that is a number of times smaller than the length that is necessary to generate a specific resonating frequency, it is necessary to use specific form factors, generally of a 3D geometry, for instance of a helical type.

At a step 820, one models the electrical response of the antenna arrangement to determine the values of the frequencies of the resonating modes. Step 820 is implemented either after the first step 810 for a single antenna element (i.e. the main trunk, N being set at 1), described above or as part of the iterative steps (N=N+1) to be performed until all target frequencies and bandwidths of the specification are obtained (step 845). There, a number of antenna elements (secondary trunks, branches and/or leaves) have been picked up from a library of antenna elements and added to the antenna arrangement. The values of all frequencies associated to the resonating modes of the antenna arrangement may be determined by analytical calculation using an electrical model of the antenna arrangement. Models are available for simple structures, generally not for complex structures. In lieu of an analytical model, a graphical representation, for instance a Smith Chart, may be used to determine the values of the frequencies of the resonating modes. Electromagnetic simulation tools may be used to find proper solutions more rapidly. Examples of analytical models, graphical representations and simulation tools are discussed further down in the description of various embodiments of the invention.

At a step 830, the values of the resonating frequencies, matching levels and bandwidths of the antenna arrangement are compared to the specification.

Steps 820 and 830 may be replayed a number of times if simple adjustments of the parameters of the same structure of antenna elements allows convergence to the values of the specification.

If all values (frequencies, matching levels, bandwidths) of the specification are tested (Step 840) and confirmed to be met, the process ends (Step 845). If not, the electrical state of the points of the antenna elements currently in the antenna arrangement where new antenna elements may be added are mapped (Step 850). Notably, the Hot Spots and Cold Spots should be marked for each resonating mode. At the spots of the first category, leaves may be added that will impart the largest shift (all other things being equal) on the frequencies of the resonating modes of the antenna arrangement. At the spots of the second category, Secondary Trunks or Branches may be added, that will impart the smallest shift on the resonating frequencies of the resonating modes of the antenna arrangement and add a number of new resonating frequencies to the antenna arrangement, if the specification is not entirely fulfilled.

Then, at a step 860, a new antenna element is selected in the library of antenna elements to be added at a relevant spot of a relevant pre-existing antenna element in the antenna arrangement. A guide to select the type of antenna element based on the type of adjustment to be made to the target specifications of the antenna arrangement is provided further down in the description. Before being added to the antenna arrangement at the adequate position, the antenna element should be configured, i.e. its adjustable parameters (dimension(s), form factor, etc . . . ) should be defined to obtain the adequate susceptance that will procure the required effects on the frequency values and the bandwidths that have to be adjusted.

Then the loop is iterated until the specification is fully met.

Figure 9:
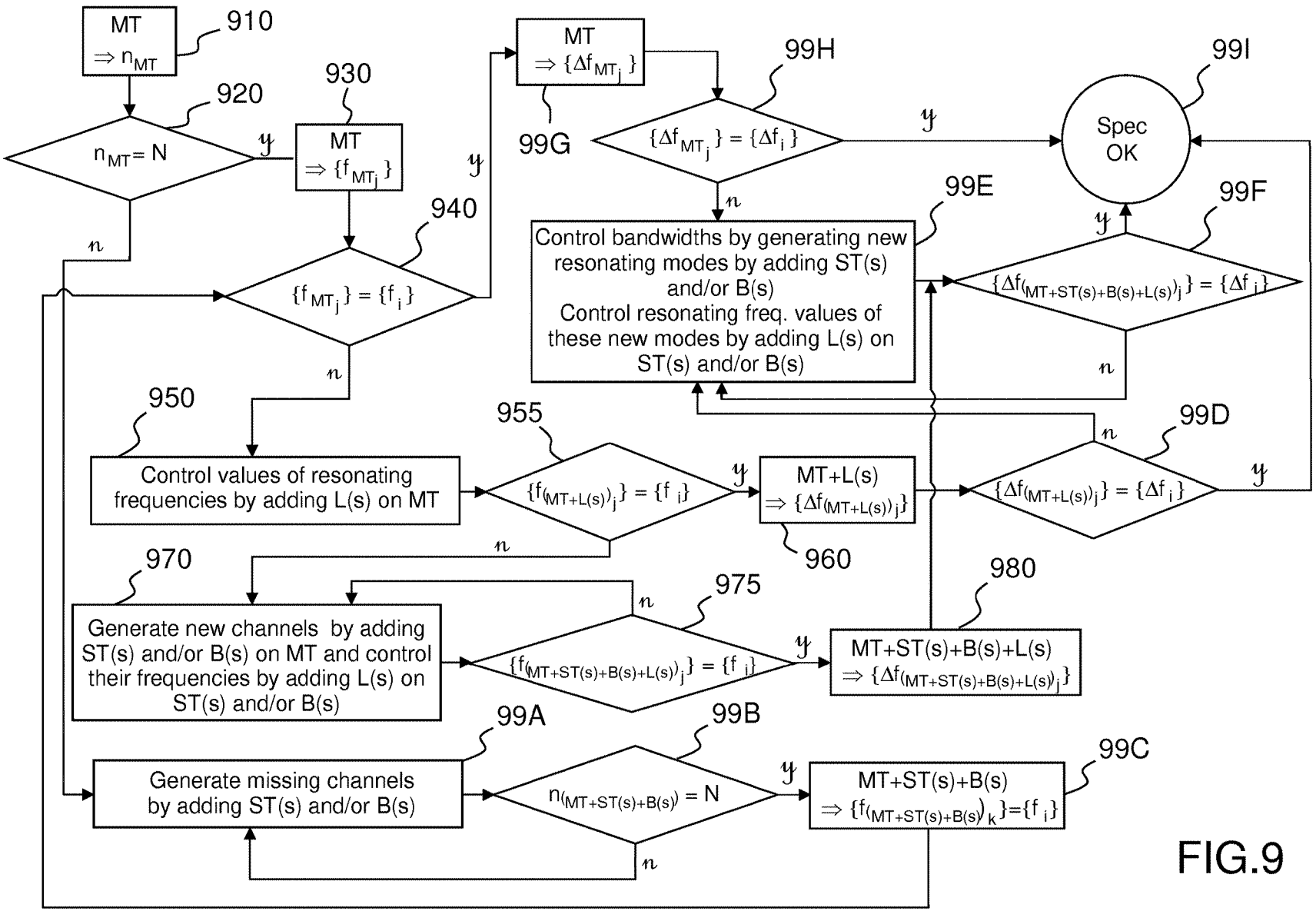
FIG. 9 is another flow chart illustrating a design method of an antenna arrangement according to some embodiments of the invention.

FIG. 9 is another flow chart illustrating a design method of an antenna arrangement according to some embodiments of the invention.

In such an embodiment of the invention, we can reformulate the specification as:

$$\{f_i, i \in \{1, \ldots, n\}\}; \forall i \in \{1, \ldots, n\},$$

$$f_i \in [f_{min}, f_{max}]$$

$$\{\Delta f_i, i \in \{1, \ldots, n\}\}; \forall i \in \{1, \ldots, n\},$$

$$f_i \pm \frac{\Delta f_i}{2} \in [f_{min}, f_{max}]$$

It may be possible to fulfil all the specifications with a single trunk. At a step 910, we define $n_{MT}$ that is the number of resonating modes of the Main Trunk that can be used to generate frequencies listed in the specification. The satisfaction of the specification in terms of number of frequency values (or channels) is tested at step 920. If the number is correct (step 930), the frequency values themselves have to be tested (step 940). If all frequency values match the specification, the bandwidths have to be tested (steps 99G and 99H). If they are OK, the specification is declared to be met (Step 99I). If not, new resonating modes have to be added to control the bandwidths by adding Secondary Trunks (ST) and/or Branches (B); the resonating frequency values can be controlled by adding Leaves (L) on Secondary Trunks (ST) or Branches (B), Step 99E. Then the result is tested (Step 99F). In case this is needed, a new antenna element is added by an iterative loop (Step 99E/Step 99F).

Coming back to step 940, if some frequency values are different from the specified frequency values, it is possible to shift the frequency values corresponding to each resonating mode of the Main Trunk by a predetermined amount (Step 950). The amount of shifting will depend on the parameters of the leaf (its geometry (1D, 2D, 3D), its form factor, its characteristic dimensions) and the position and orientation of the leaf on the trunk. Then the frequency values are tested against the specification in the new configuration (step 955). If the frequency values are all OK, the method then goes on to test the bandwidths (steps 960 and 99D). If this is OK, the specification is declared to be met (step 99I). If this is KO, the method branches at step 99E. If, at the output of test 955, one of the frequency values is KO, new channels are generated, tested and followed by tests on resonating frequency values and on bandwidths (steps 970, 975, 980).

Coming back to step 920, if the number of frequencies generated on the Main Trunk is lower than the number required by the specification, it is possible to generate missing channels by adding Secondary Trunks (ST) and/or Branches (B), step 99A. The number of channels is then tested (step 99B) with a loop with step 99A. Then the list of resonating frequencies is established (step 99C) and the method branches to step 940.

As explained above, the intrinsic parameters of the antenna elements (MT, ST, B, L) that can be tuned to meet the specification are their geometry (1D, 2D, 3D), their form factor and their characteristic dimensions. Also, their impact on the resonating frequencies of the whole antenna arrangement will depend on their composition (single element or an element to which sub-elements—Branches or Leaves—are connected) and their position relative to the Hot Spots and Cold Spots of the MT, ST or B to which it is appended.

The calculation of the resonating frequencies and the corresponding bandwidths for definite matching levels for a composition of the antenna arrangement, sets of parameters of each of the antenna elements and their positions may be performed analytically, graphically or by simulation. Likewise, the resolution of the inverse problem (finding sets of antenna elements, their intrinsic parameters and their positions that generate a set of resonating frequencies with defined bandwidths for a matching level) can also be obtained by one of these methods. Also, some artificial intelligence or knowledge-based tools, such as neural networks, may be used with tools to simulate or model the solutions as a function of the parameters, to explore the space of solutions of the inverse problem more rapidly. Simulation tools known to a person of ordinary skill in antenna design are for example CST™, HFSS™, Feko™ or Comsol™. But any other proprietary software having similar functionalities may also be used.

According to the invention, the different types of antenna elements (Main Trunk, Secondary Trunk, Branch, Leaf) have the following uses for a designer who has to design an antenna arrangement according to a specification, and may be combined to meet the parameters (resonating frequencies and bandwidths for a defined matching level) of the specification:

- a Main Trunk is used to generate a group of resonating frequencies corresponding to the proper resonating modes of this Main Trunk;

a Secondary Trunk, that is connected to the feed line of the Main Trunk, is used to generate a group of new resonating frequencies corresponding to the proper resonating modes of this Secondary Trunk;

a Branch, that is connected to a Main Trunk (MT), a Secondary Trunk (ST) or another Branch (B), is used to generate new resonating frequencies of the antenna arrangement comprising the MT, ST and pre-existing B; these resonating frequencies may be separate from the resonating frequencies of the proper modes of the MT, ST and pre-existing B or generate a bandwidth at a defined matching level around pre-existing proper modes, or a combination of both;

a Leaf, that has a main dimension D that is defined according to the rules commented upon above in relation to FIG. 3*e* and is connected to a Main Trunk (MT), a Secondary Trunk (ST) or a Branch (B), is used to shift the frequencies of the proper modes of the antenna assembly to which it is connected.

Based on these design rules and using the iterative algorithms, the calculations and the tools described in this specification, it is possible to build a database of antenna elements that allow matching all kinds of specifications.

FIGS. 10*a*, 10*c*, 10*e* and 10*g* represent examples of assemblies of antenna elements according to some embodiments of the invention and FIGS. 10*b*, 10*d*, 10*f* and 10*h* represent their respective frequency responses.

Figures 10A, 10B, 10C, 10D, 10E, 10F, 10G, 10H:
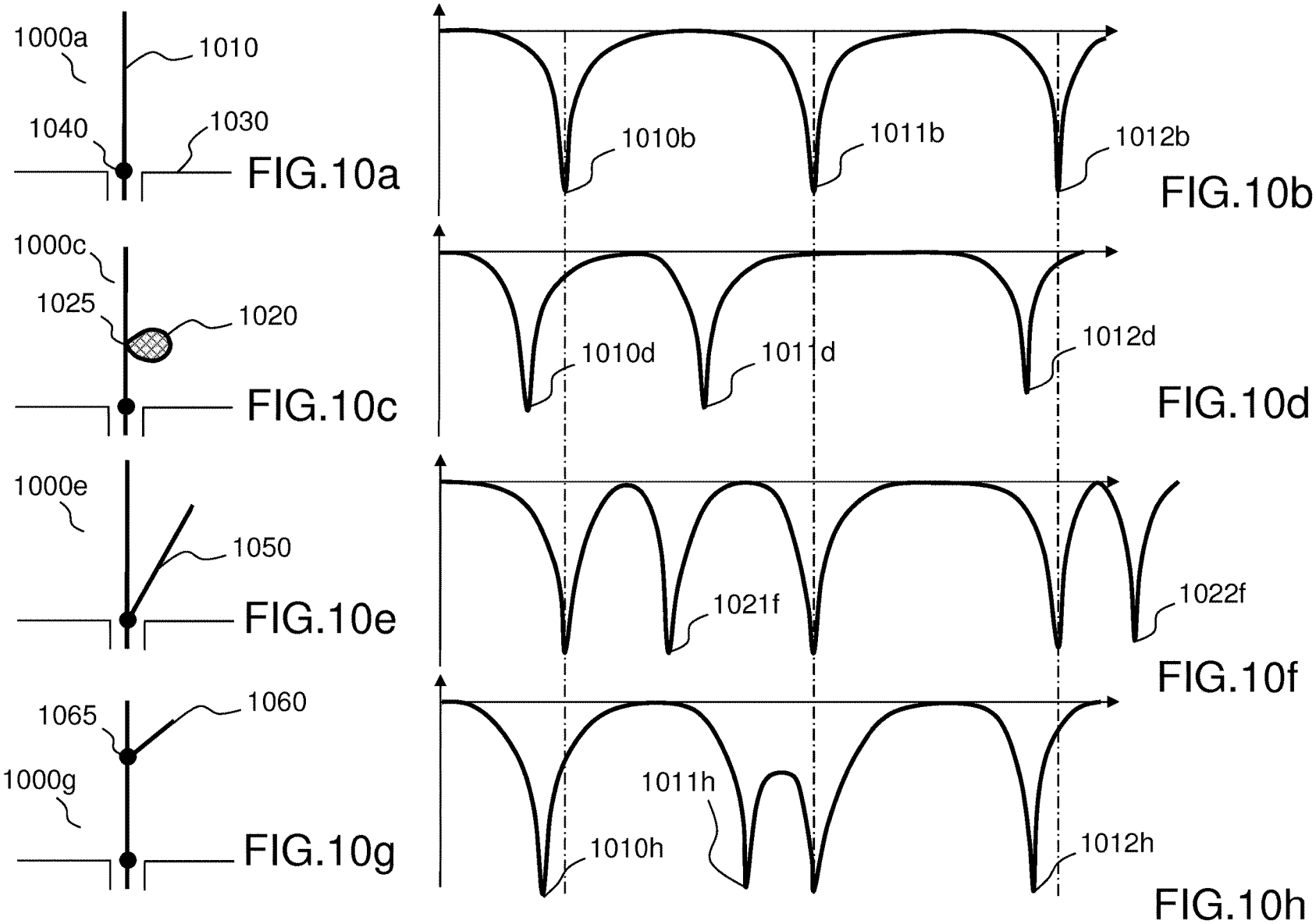
FIGS. 10*a*, 10*c*, 10*e* and 10*g* represent examples of assemblies of antenna elements according to some embodiments of the invention
FIGS. 10*b*, 10*d*, 10*f* and 10*h* represent their respective frequency responses.

On FIG. 10*a*, the antenna arrangement 1000*a* is a simple monopole antenna with an omnidirectional radiating pattern in the azimuth plane. The dimensions of this arrangement are selected so that the antenna is fit to operate in the ISM (Industrial, Scientific, Medical), VHF or UHF bands. It can be seen as a tree comprising only a trunk 1010. The tree is planted on a ground plane 1030.

The Main Trunk 1010 is formed of a conductive material, metallic wire or ribbon, with a deployed physical length $\ell$ which is defined as a function of the desired radiating frequency of the fundamental mode as already explained above. At this frequency, $\ell=\lambda/4$. The trunk may be inscribed in a plane. In some embodiments, the plane in which the trunk is inscribed may be parallel to the ground plane, for instance when the antenna arrangement is produced using a micro strip technology, or may be inscribed in the ground plane in a solution where the antenna and the ground plane are designed as a coplanar arrangement. In such an arrangement, the antenna may be engraved on a face of the substrate and the ground plane may be engraved on the backplane of the substrate. In other embodiments, the plane in which the trunk is inscribed is perpendicular to the ground plane. The trunk may alternatively be inscribed in a non-planar surface or a volume structure. Such a form factor is advantageous to increase the compactness of an antenna arrangement of a given physical length $\ell$.

The ground plane 1030 is the metallic backplane of a PCB structure which comprises the excitation circuits which feed the RF signal to the trunk at their point of mechanical and electrical connection 1040.

At this step, it is useful to introduce the notion of "electrical length" of a radiating element. The electrical length $\ell_{e(\lambda)}$ of an element of physical length $\ell$ at a wavelength $\lambda$ is defined by $\ell_{e(\lambda)}=\ell/\lambda$. Then, if the radiation propagates in a media of electromagnetic permittivity $\varepsilon_r$, where $\lambda=c/f\sqrt{\varepsilon_r}$, we will have $\ell_{e(\lambda)}=\ell\times f\times\sqrt{\varepsilon_r}/c$. In air, where $\varepsilon_r=1$, we then have $\ell_{e(\lambda)}=\ell\times f/c$.

It is possible to express an electrical length in degrees or in radians. For instance, for $\ell_{e(\lambda)}=1/4$ (in $\lambda$ unit), we can express this value as $\ell_{e(°)}=90$ (in degree unit) or $\ell_{e(rad)}=\pi/2$ (in radian unit).

The different radiating modes are basically defined by the electrical length of the radiating pole element:

The fundamental mode is defined by an electrical length $\ell_{e(\lambda)}$ of the radiating element which is equal to 1/4 ($\lambda$) (first harmonic) where $\lambda=c/f$, f being the radiating frequency at the fundamental mode;

The 1st higher order mode is defined by an electrical length $\ell_{e(\lambda_1)}$ of the radiating element which is equal to 3/4 ($\lambda_1$) (third harmonic) where $\lambda_1=c/f_1$, $f_1$ being the resonating frequency of the first higher order mode of the radiating element;

The 2nd higher order mode is defined by an electrical length $\ell_{e(\lambda_2)}$ of the radiating element which is equal to 5/4 ($\lambda_2$) (fifth harmonic) where $\lambda_2=c/f_r$, $f_2$ being the resonating frequency of the second higher order mode of the radiating element;

The 3rd higher order mode is defined by an electrical length $\ell_{e(\lambda_3)}$ of the radiating element which is equal to 7/4 ($\lambda_3$) (seventh harmonic) where $\lambda_3=c/f_3$, $f_3$ being the resonating frequency of the third higher order mode of the radiating element.

The resonating frequency f of the fundamental mode and the resonating frequencies of the first and the second higher modes, $f_1$ and $f_2$, are represented on graphical representations of the frequency response of the radiating element (FIG. 10*b*) by reference numerals 1010*b*, 1011*b*, 1012*b*, respectively.

The antenna arrangement 1000*c* of FIG. 10*c* comprises a Leaf (L) 1020 that is positioned on the Main Trunk 1010 at point 1025. The Leaf is also metallic and is mechanically and electrically connected to the Main Trunk, its position 1025 being normally selected to maximize its impact on the shift in frequency of one of resonating modes of the Main Trunk. The shift in frequency will also depend on the geometry, the form factor, the dimensions and the orientation of the leaf 1020.

These dependencies are disclosed in European patent application filed under n° EP2016/306059.3, this antenna arrangement being analogous to a compact tree structure that in some aspects resembles the structure of a bonsai.

It is also possible to define an equivalent electrical length $\ell_{e(\lambda)eq}$. For instance, if a leaf of defined geometry, form factor and dimension is added on a trunk at a defined position with a defined orientation, the combination of the trunk and the leaf will have an equivalent electrical length defined by $\ell_{e(\lambda)eq}=\ell\times f/c+\Delta\ell_{e(\lambda)}(f)$, where $\Delta\ell_{e(\lambda)}(f)$, being a function of frequency f, is a variation of the electrical length of the trunk that is a consequence of the addition of the leaf.

There may be a plurality of leaves. The leaves may be seen as structures extending the length of the antenna of a defined amount in defined directions. They may be inscribed together in a same plane or different surfaces or not. They may be coplanar with the trunk or not.

FIG. 10*d* illustrates the shift imparted by the leaf 1020 to the resonating frequencies of the Main Trunk 1010:

f becomes f' (reference 1010*d* on FIG. 10*d*);

$f_1$ becomes $f'_1$ (reference 1011*d* on FIG. 10*d*);

and $f_2$ becomes $f'_2$ (reference 1012*d* on FIG. 10*d*).

It can be seen that the shift in frequency is the largest for the first higher order mode: the difference between the positions 1011*b* and 1011*d* being larger than the difference between the positions 1010*b* and 1010*d* and the difference between the positions 1012*b* and 1012*d*. This is determined by the position of the leaf on the Main Trunk. It can also be seen that the resonating frequencies are shifted to lower values because the total electrical length of the antenna arrangement is increased.

The antenna arrangement 1000*e* of FIG. 10*e* comprises a Secondary Trunk (ST) 1050 that is positioned at the point 1040 of mechanical and electrical connection of the Main Trunk 1010 (also called feed line point). The ST is also metallic and is mechanically and electrically connected to the Main Trunk.

As already discussed, the ST 1050 may have different geometries, form factors, dimensions and orientations.

Since it is connected to the unique point that is a Cold Spot for all resonating modes of the Main Trunk 1010, there is no impact on the frequencies of these resonating modes that remain unchanged as illustrated on FIG. 10*f* where f, $f_1$ and $f_2$ are located at the same positions 1010*b*, 1011*b* and 1012*b* as on FIG. 10*b*.

If mandated by the specification, new radiating frequencies are created by the addition of the ST 1050:

$f^{(1)}$, reference numeral 1021*f*;

$f_1^{(1)}$, reference numeral 1022*f*.

The antenna arrangement 1000*g* of FIG. 10*g* comprises a Branch (B) 1060 that is positioned at a point 1065 of the Main Trunk 1010. The Branch is also metallic and is mechanically and electrically connected to the Main Trunk, its position 1065 being normally selected to minimize its impact on radiating frequencies of the resonating modes of the Main Trunk. A Cold Spot for one or more of the radiating modes of the Main Trunk is preferred.

As illustrated on FIG. 10*h*, a new radiating mode at frequency $f^{(2)}$ is created (reference 1011*h*), while the frequency of the first order resonating mode $f_1$ (reference 1011*b*) is not affected, because the point 1065 is a Cold Spot for this first order resonating mode. The frequencies of the fundamental resonating mode (f, 1010*b*) and of the second higher order mode ($f_2$, 1012*b*) are shifted to lower frequencies (f", 1010*h*, and $f''_2$, 1012*h*).

Figure 11A:
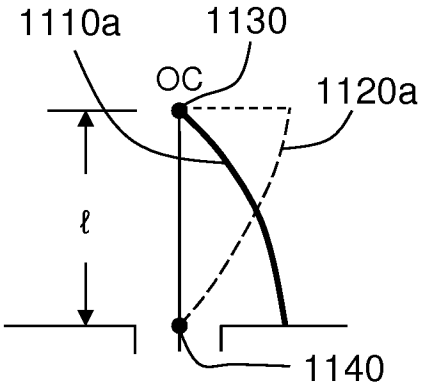
FIGS. 11*a*, 11*c* and 11*e* represent the distribution of current and voltage of the fundamental, the first higher and the second higher resonating modes of a monopole antenna and FIGS. 11*b*, 11*d*, and 11*f* respectively illustrate the calculation of the input admittance of the antenna arrangement at each of these harmonics on a Smith Chart.
Figure 11C:
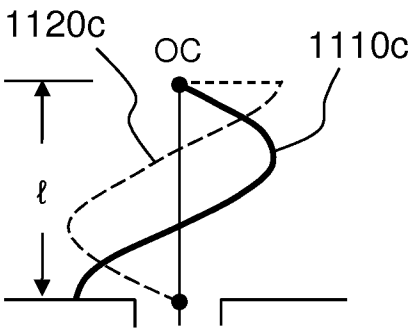
Figure 11E:
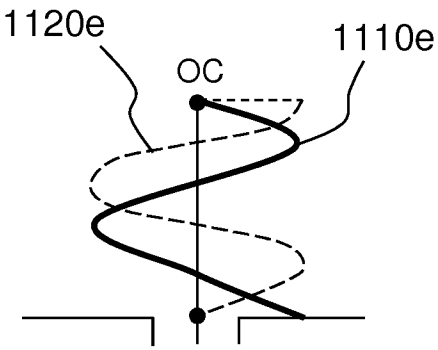
Figure 11B:
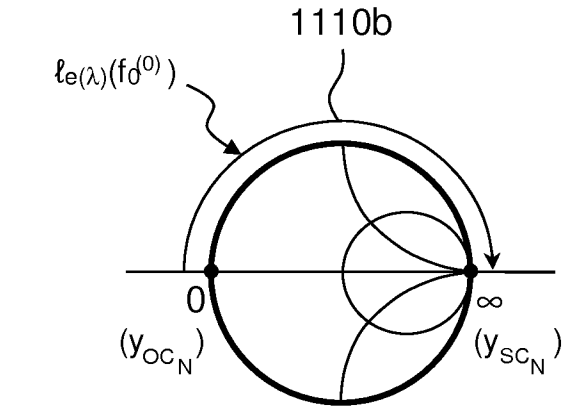
Figure 11D:
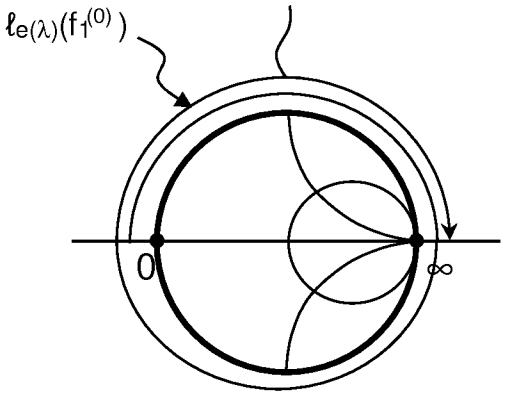
Figure 11F:
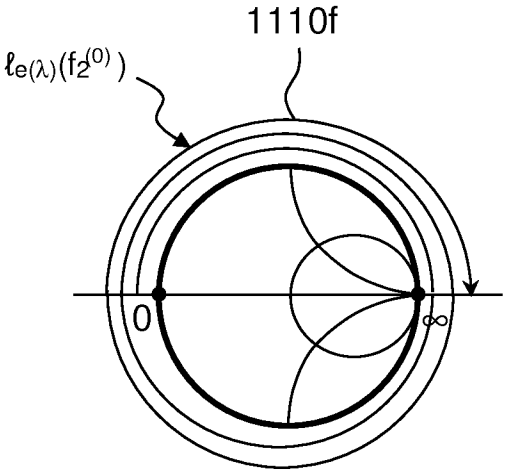

FIGS. 11*a*, 11*c* and 11*e* represent the distribution of current and voltage of the fundamental mode, the first and second higher order modes of a monopole antenna and FIGS. 11*b*, 11*d*, and 11*f* respectively illustrate the calculation of the input admittance of the antenna arrangement at each of these modes on a Smith Chart.

FIG. 11*a* represents the distribution of current (curve 1110*a*), respectively the distribution of voltage (curve 1120*a*), for the fundamental mode (or first harmonic) of a monopole antenna of length $\ell$ between the connection to the feed line 1140 (or Short Circuit point) and the Open Circuit point 1130, that is the top extremity of the monopole. The resonating frequency of the fundamental mode $f_0^{(0)}$ is defined by:

$$f_0^{(0)}=c/4\ell.$$

The electrical length of the antenna at the fundamental mode $\ell_{e(\lambda)}(f_0^{(0)})$ is represented by curve 1110*b* on FIG. 11*b* that displays a Smith Chart characterizing the antenna at the fundamental mode. It covers half a turn clockwise on the Smith Chart.

The normalized input admittance of the antenna is defined as:

$$Y_{ant_N}=Y_{ant}/Y_C,$$

where $Y_C$ is the characteristic admittance of the monopole antenna.

At the fundamental mode $Y_{ant_N}(f_0^{(0)})$ is infinite at the SC point and is therefore given by the following formula:

$$Y_{ant_N}(f_0^{(0)})=j\times\infty.$$

Likewise, FIG. 11*c* represents the distribution of current (curve 1110*c*), respectively the distribution of voltage (curve 1120*c*), for the first higher order mode (or third harmonic) of a monopole antenna of length $\ell$ between the connection to the feed line 1140 (or Short Circuit point) and the Open Circuit point 1130, that is the free extremity of the monopole. The resonating frequency of the first higher order mode) $f_1^{(0)}$ is defined by $f_1^{(0)}=3c/4\ell$.

One also has $f_1^{(0)}=3f_0^{(0)}$.

The electrical length of the antenna at the first higher order mode $\ell_{e(\lambda)}(f_1^{(0)})$ is represented by curve 1110*d* on FIG. 11*d* that displays a Smith Chart characterizing the antenna at the first higher mode. It covers a turn and a half clockwise on the Smith Chart.

The normalized input admittance of the antenna at the first higher order mode $Y_{ant_N}(f_1^{(0)})$ is infinite at the SC point and is therefore given by $Y_{ant_N}(f_1^{(0)})=j\times\infty$.

Likewise, FIG. 11*e* represents the distribution of current (curve 1110*e*), respectively the distribution of voltage (curve 1120*e*), for the second higher order mode (or fifth harmonic) of a monopole antenna of length $\ell$ between the connection to the feed line 1140 (or Short Circuit point) and the Open Circuit point 1130, that is the free extremity of the monopole. The resonating frequency of the first higher order mode $f_2^{(0)}$ is defined by $f_2^{(0)}=5c/4\ell$.

One also has $f_2^{(0)}=5f_0^{(0)}$.

The electrical length of the antenna at the second higher order mode)) $\ell_{e(\lambda)}(f_2^{(0)})$ is represented by curve 1110*f* on FIG. 11*f* that displays a Smith Chart characterizing the antenna at the second higher mode. It covers two turns and a half clockwise on the Smith Chart.

The normalized input admittance of the antenna at the second higher order mode $Y_{ant_N}(f_2^{(0)})$ is infinite at the SC point and is therefore given by the following formula:

$$Y_{ant_N}(f_2^{(0)})=j\times\infty.$$

It is of course possible to generalize the representations and calculations of FIGS. 11*a* through 11*f* for higher order modes.

Using Smith Charts allows combining the admittances/susceptances of various antenna elements at their points of connections as explained below.

Figure 12B:
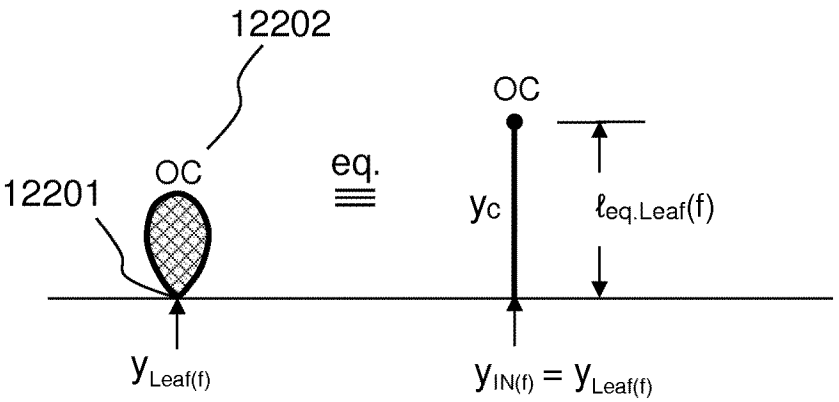
FIGS. 12*a*, 12*b* and 12*c* illustrate the calculation of the equivalent physical length of a leaf and FIGS. 12*d*, 12*e* and 12*f*, the impact of a leaf positioned on a trunk respectively on the fundamental, the first higher and the second higher resonating modes of the trunk.
Figure 12A:
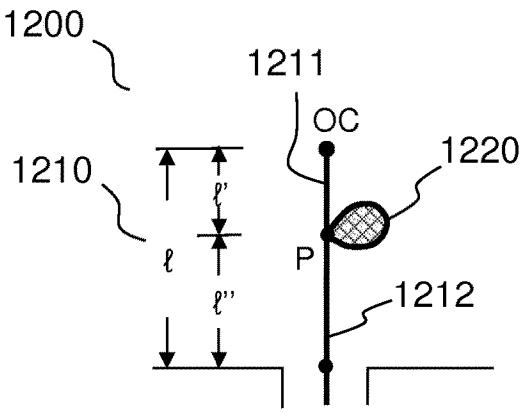
Figure 12C:
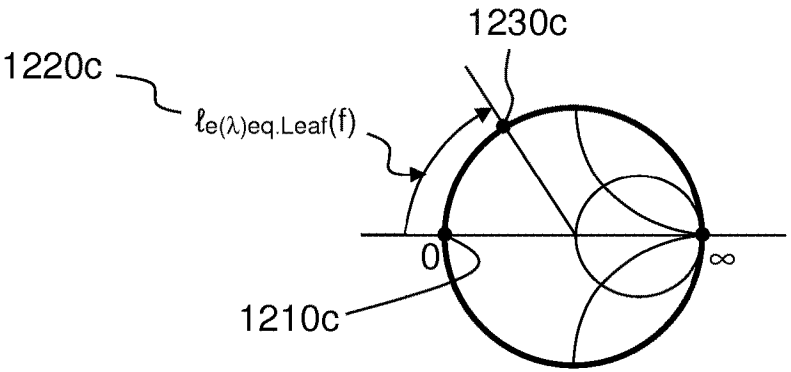
Figure 12D:
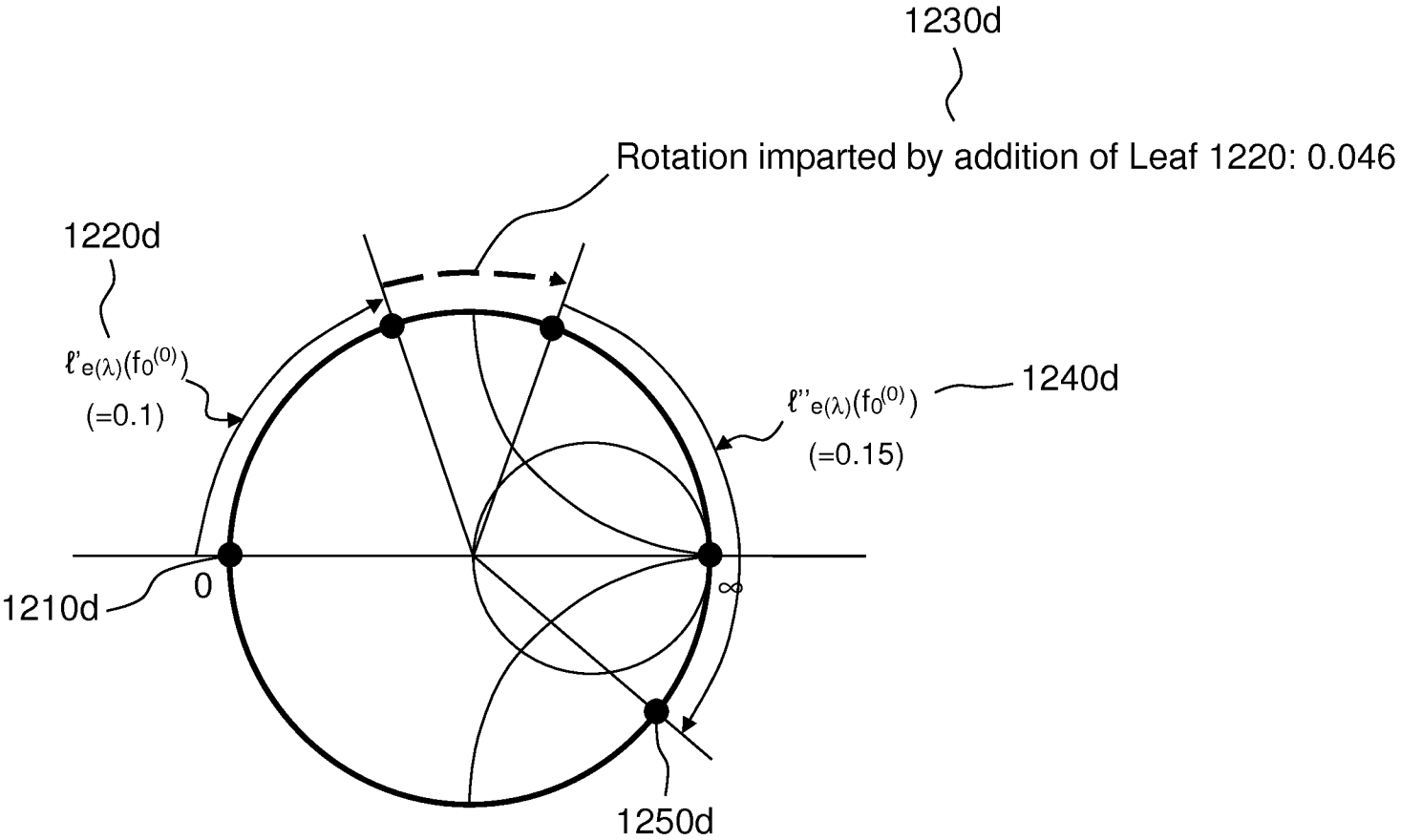
Figure 12E:
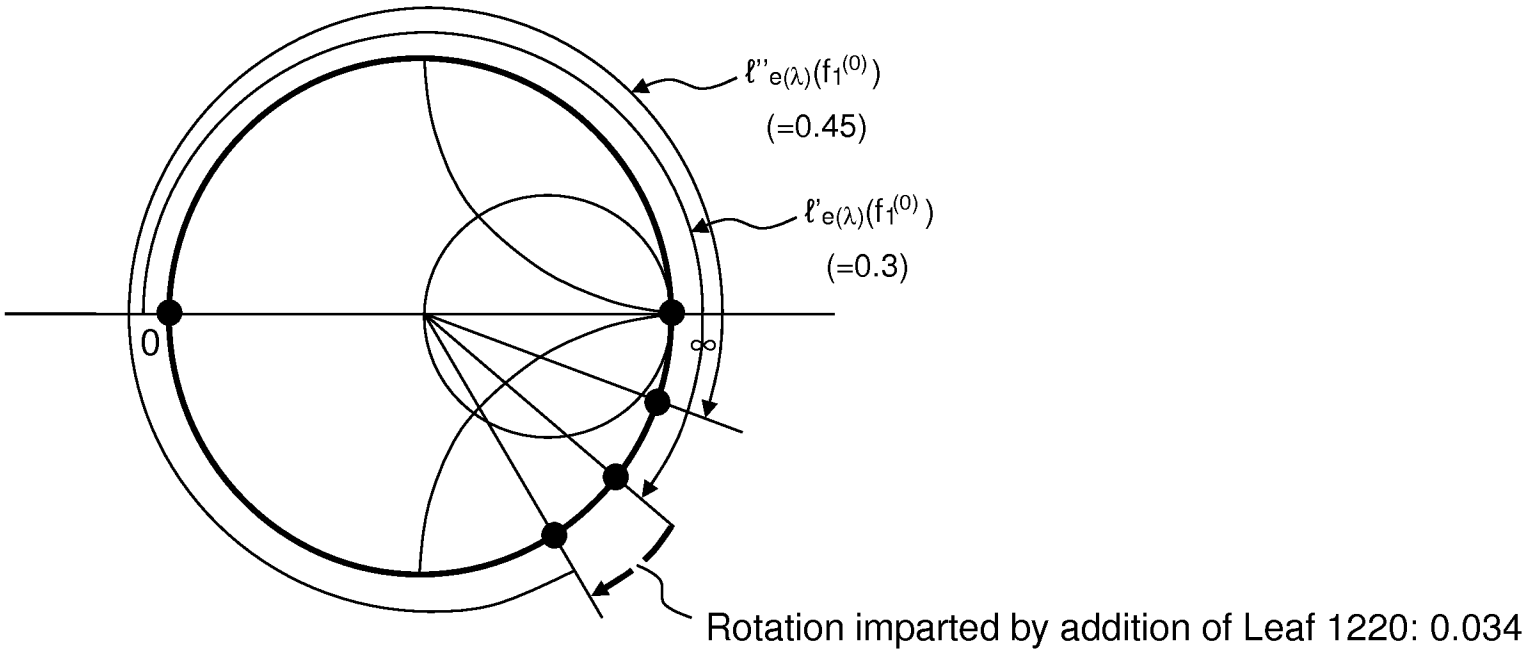
Figure 12F:
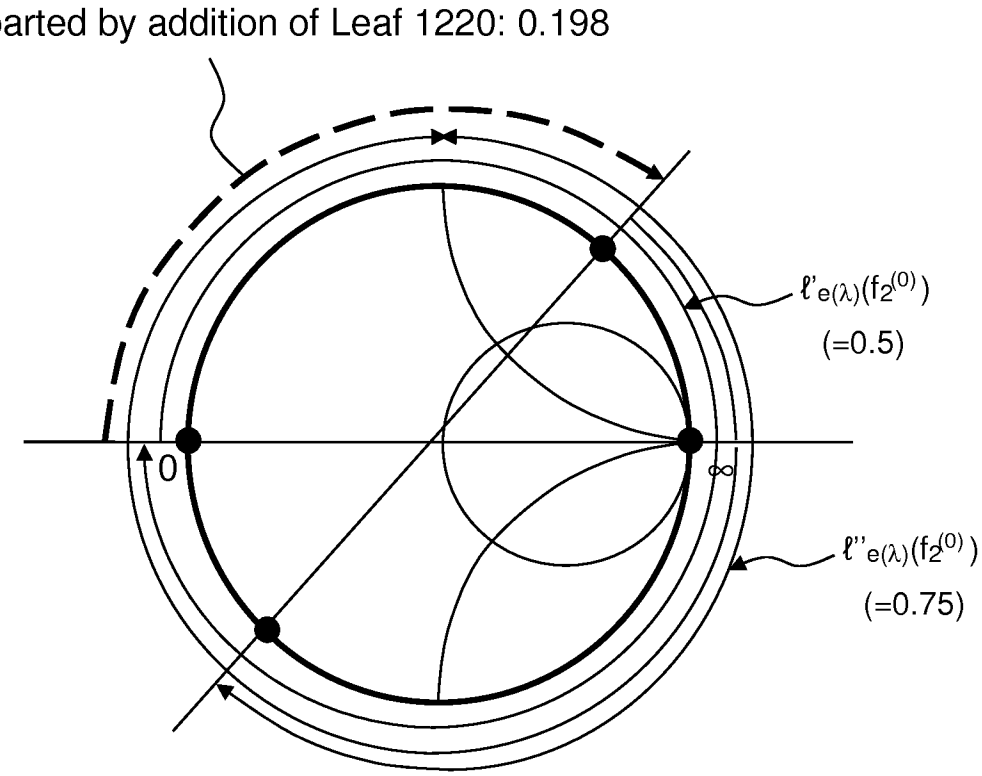

FIGS. 12*a*, 12*b* and 12*c* illustrate the calculation of the equivalent physical length of a leaf and FIGS. 12*d*, 12*e* and 12*f*, the impact of a leaf positioned on a trunk respectively on the fundamental mode, the first higher order and the second higher order modes of the trunk.

FIG. 12*a* represents an antenna arrangement 1200 having a Leaf 1220 connected on a Main Trunk 1210 at a point P that defines two segments 1211 of length $\ell'$ and 1212 of length $\ell''$ such that $\ell=\ell'+\ell''$.

FIG. 12*b* illustrates the calculation of the equivalent physical length and of admittances of the Leaf 1220.

We define the equivalent physical length at frequency f of the Leaf as the length $\ell_{eq.Leaf}(f)$ (with $\ell_{eq.Leaf}(f)\in[0,\lambda/4[$)

of a rectilinear antenna element that would have the same input admittance $Y_{IN}(f)$ as the Leaf; one must then solve:

$$Y_{IN}(f)=Y_{Leaf}(f).$$

$Y_{Leaf}(f)$ is a function of the intrinsic and extrinsic parameters of the Leaf 1220 (geometry, form factor, dimension and orientation).

If the equivalent rectilinear antenna element is presented with an input admittance $Y_{IN}(f)$ at the connection P, 12201 with the Main Trunk, 1210, and has an admittance $Y_L$ at its distal end OC, 12202, one has the following relationship between the admittances defined on the Leaf:

$$Y_{IN}(f) = Y_C \times \frac{Y_L + j \times Y_C \times tg(\beta \ell_{eq.Leaf}(f))}{Y_C + j \times Y_L \times tg(\beta \ell_{eq.Leaf}(f))} \quad \text{(Eq. 5)}$$

When the propagation media is the ambient air, we have $\beta=2\pi/\lambda$ or $\beta=2\pi\times f/c$. Then, Equation 5 can be solved graphically or analytically.

The graphical resolution is illustrated on the Smith Chart of FIG. 12*c*.

If we define $\ell_{e(\lambda)eq.Leaf}(f)$ as the equivalent electrical length of Leaf 1220 ($\ell_{e(\lambda)eq.Leaf}(f)=\ell_{eq.Leaf}(f)/\lambda$, with $\ell_{e(\lambda)eq.Leaf}(f) \in [0,1/4[$), the normalized input admittance $Y_{IN_N}(f)$ of the Leaf (that is equal to $Y_{Leaf_N}(f)$) can be read on the Smith Chart at the point 1230*c* after a clockwise rotation of an arc distance 1220*c* starting from the OC position 1210*c* and representing the equivalent electrical length $\ell_{e(\lambda)eq.Leaf}(f)$.

The analytical resolution of Equation 5 uses the fact that $Y_L=Y_{OC}=0$. Thus:

$$Y_{Leaf}(f)=j\times Y_C\times tg(\beta \ell_{eq.Leaf}(f)) \quad \text{(Eq. 6)}$$

Under the assumption that Leaf 1220 is lossless, we are in a position to assume that $Y_{Leaf}(f)=j\times B_{Leaf}(f)$. We thus have:

$$B_{Leaf}(f)=Y_C\times tg(\beta \ell_{eq.Leaf}(f)) \quad \text{(Eq. 7)}$$

with $B_{Leaf}(f) \in [0,+\infty[$ and $\beta \ell_{eq.Leaf}(f) \in \lfloor 0,\pi/2 \rfloor$ that converts into:

$$\ell_{eq.Leaf}(f) = \frac{c}{2\pi f} \times arctg\left(\frac{B_{Leaf}(f)}{Y_C}\right) \quad \text{(Eq. 8)}$$

$$\text{with } \ell_{eq.Leaf}(f) \in \lfloor 0, \lambda/4 \rfloor$$

Equations 7 and 8 define a relationship between the susceptance at the feed point 12201 of the Leaf 1220 and the equivalent length of this Leaf at frequency f.

FIG. 12*d* illustrates the impact of the addition of Leaf 1220 on the frequency of the fundamental mode of the Main Trunk 1210 in an embodiment.

In this embodiment we have as an example only: $\ell'=0.1\times\lambda_{f_o^{(0)}}$; $\ell''=0.15\times\lambda_{f_o^{(0)}}$; and thus, $\ell=\ell'+\ell''=\lambda_{f_o^{(0)}}/4=0.25\times\lambda_{f_o^{(0)}}$, i.e. the Main Trunk has a length equal to the quarter of the wavelength corresponding to the resonating frequency $f_0^{(0)}$ of the fundamental mode.

The parameters (geometry, form factor, dimensions) of the Leaf 1220 are such that $Y_{Leaf_N}(f_0^{(0)})=j\times0.57$. The Leaf 1220 has in particular dimensions that are small enough for its equivalent length to be lower than $\lambda_{f_o^{(0)}}/4$.

On the Smith Chart of FIG. 12*d*, we start from the OC point, 1210*d*, on the left-hand side of the Chart, that defines the origin of the Chart for the admittances, and then move clock wise by adding the equivalent electrical length $\ell'_{e(\lambda)}(f_0^{(0)})=0.1$ of the antenna segment, starting with one segment the distal end of which is the OC.

The first segment 1211 of electrical length $\ell'_{e(\lambda)}(f_0^{(0)})°0.1$ at frequency $f_0^{(0)}$ that is the frequency of the fundamental mode of the antenna arrangement generates a normalized input admittance $Y_{l'_N}(f_0^{(0)})$ that is such that $Y_{l'_N}(f_0^{(0)})=j\times0.73$.

The normalized admittance at point P, 12201, at the frequency $f_0^{(0)}$ of the fundamental mode of the antenna arrangement, $Y_{P_N}(f_0^{(0)})$ is the sum of the normalized input admittance of segment 1211, $Y_{l'_N}(f_0^{(0)})$, segment 1220*d*, and of the normalized input admittance of the Leaf 1220, $Y_{Leaf_N}(f_0^{(0)})$, segment 1230*d*.

We then have a total normalized input admittance at point P, $Y_{P_N}(f_0^{(0)})$, that is:

$$Y_{P_N}=Y_{l'_N}(f_0^{(0)})+Y_{Leaf_N}(f_0^{(0)})=j\times(0.73+0.57)=j\times1.3 \quad \text{(Eq. 9)}$$

Thus, the Leaf adds a rotation of 0.046 at $f_0^{(0)}$.

We then add the electrical length $\ell''_{e(\lambda)}(f_0^{(0)})=0.15$ of the second segment 1212 of the Main Trunk 1210, that determines a rotation 1240*d* that leads to point 1250*d* On the Smith Chart that determines a total rotation $Rot_{Ant}$ where the normalized input admittance of the antenna arrangement, $Y_{122_N}(f_0^{(0)})$ can be read.

$$Rot_{Ant}=\ell'_{e(\lambda)}(f_0^{(0)})+Rot_{Leaf1220}+\ell''_{e(\lambda)}(f_0^{(0)}) \quad \text{(Eq. 10)}$$

where $Rot_{Leaf1220}=0.046$ (arc 1230*d*).

In the example illustrated on FIG. 12*d*, we have $Y_{1200_N}(f_0^{(0)})=j\times3.4$.

We thus have an equivalent length of the antenna element 1200 $\ell_{1200}(f_0^{(0)})$ that is higher than a quarter wavelength at $f_0^{(0)}$. The new fundamental mode of the antenna arrangement is therefore at a frequency $f_0^{(1)}$ that is such that $\ell_{1200}(f_0^{(1)})=\lambda_{f_o^{(1)}}/4$. The Leaf 1220 has thus decreased the frequency of the fundamental mode of the antenna arrangement 1200.

FIG. 12*e* illustrates the impact of the addition of Leaf 1220 on the frequency of the first higher order mode of the Main Trunk 1210 in an embodiment.

We have $\ell'=0.3\times\lambda_{f_1^{(0)}}$; $\ell''=0.45\times\lambda_{f_1^{(0)}}$; and thus, $$\ell=\ell'+\ell''=0.75\times\lambda_{f_1^{(0)}}=3/4\times\lambda_{f_1^{(0)}}$$

The parameters (geometry, form factor, dimensions) of the Leaf 1220 are such that $Y_{Leaf_N}(f_1^{(0)})=j\times1.4$. The Leaf 1220 has in particular dimensions that are small enough for its equivalent length to be lower than $\lambda_{f_1^{(0)}}/4(=\lambda_{f_0^{(0)}}/12)$.

On the Smith Chart of FIG. 12*e*, we start from the OC point on the left-hand side of the Chart, that defines the origin of the Chart for the admittances, and then move clock wise by adding the equivalent electrical length of the antenna segments, starting with one segment the distal end of which is the OC.

The first segment 1211 of electrical length $\ell'_{e(\lambda)}(f_1^{(0)})=0.3$ at frequency $f_1^{(0)}$ that is the frequency of the first higher order mode of the antenna arrangement generates a normalized input admittance $Y_{l'_N}(f_1^{(0)})$ that is such that $Y_{l'_N}(f_1^{(0)})=-j\times3.1$.

The normalized admittance at point P, 12201, at the frequency $f_1^{(0)}$ of the first higher order mode of the antenna arrangement, $Y_{P_N}(f_1^{(0)})$ is the sum of the normalized input admittance of segment 1211, $Y_{l'_N}(f_1^{(0)})$, and of the normalized input admittance of the Leaf 1220, $Y_{Leaf_N}(f_1^{(0)})$.

Starting from point P where the normalized input admittance is $Y_{P_N}=Y_{l'_N}(f_1^{(0)})+Y_{Leaf_N}(f_1^{(0)})=-j\times3.1+j\times1.4=-j\times1.7$, we then add the electrical length $\ell''_{e(\lambda)}(f_1^{(0)})=0.45$ of the second segment 1212 of the Main Trunk 1210 and then determine the normalized input admittance of the combined antenna arrangement 1200.

Equation 10 applies with replacing $f_0^{(0)}$ by $f_1^{(0)}$. We thus have $Y_{1200_N}(f_1^{(0)})=-j\times4.6$.

We thus have an equivalent length of the antenna element 1200 $\ell_{1200}(f_1^{(0)})$ that is higher than three quarter wavelength at $f_1^{(0)}$. The new fundamental mode of the antenna arrangement is therefore at a frequency $f_1^{(1)}$ that is such that $\ell_{1200}(f_1^{(1)})=3\lambda_{f_1^{(1)}}/4$. The Leaf 1220 has thus decreased the frequency of the first higher order mode of the antenna arrangement 1200.

FIG. 12*f* illustrates the impact of the addition of Leaf 1220 on the frequency of the second higher order mode of the Main Trunk 1210 in an embodiment.

We have $\ell'=0.5\times\lambda_{f_2^{(0)}}$; $\ell''=0.75\times\lambda_{f_2^{(0)}}$; and thus, $$\ell=\ell'+\ell''=1.25\times\lambda_{f_2^{(0)}}=5/4\lambda_{f_2^{(0)}}.$$

The parameters (geometry, form factor, dimensions) of the Leaf 1220 are such that $Y_{Leaf_N}(f_2^{(0)})=j\times3.0$. The Leaf 1220 has in particular dimensions that are small enough for its equivalent length to be lower than $\lambda_{f_2^{(0)}}/4(=\lambda_{f_0^{(0)}}/20)$.

On the Smith Chart of FIG. 12*f*, starting from the OC point on the left-hand side of the Chart, that defines the origin of the Chart for the admittances, and then move clock wise by adding the equivalent electrical length of the antenna segments, starting with one segment the distal end of which is the OC.

The first segment 1211 of electrical length $\ell'_{e(\lambda)}(f_2^{(0)})=0.5$ at frequency $f_2^{(0)}$ that is the frequency of the second order higher mode of the antenna arrangement generates a normalized characteristic admittance $Y_{l'_N}(f_2^{(0)})$ that is such that $Y_{l'_N}(f_2^{(0)})=j\times0$.

The normalized input admittance at point P, 12201, at the frequency $f_2^{(0)}$ of the second higher order mode of the antenna arrangement, $Y_{P_N}(f_2^{(0)})$ is the sum of the normalized input admittance of segment 1211, $Y_{l'_N}(f_2^{(0)})$, and of the normalized input admittance of the Leaf 1220, $Y_{Leaf_N}(f_2^{(0)})$.

Starting from point P where the normalized input admittance is $Y_{P_N}=Y_{l'_N}(f_2^{(0)})+Y_{Leaf_N}(f_2^{(0)})=j\times0+j\times3=j\times3$, we then add the electrical length $\ell''_{e(\lambda)}(f_2^{(0)})=0.75$ of the second segment 1212 of the Main Trunk 1210 and then determine the normalized input admittance of the combined antenna arrangement 1200.

Equation 10 applies with replacing $f_0^{(0)}$ by $f_2^{(0)}$. We then have $Y_{1200_N}(f_2^{(0)})=-j\times0.33$ We thus have an equivalent length of the antenna element 1200 $\ell_{1200}(f_2^{(0)})$ that is higher than five quarter wavelength at $f_2^{(0)}$. The new fundamental mode of the antenna arrangement is therefore at a frequency $f_2^{(1)}$ that is such that $\ell_{1200}(f_2^{(1)})=5\lambda_{f_2^{(1)}}/4$. The Leaf 1220 has thus decreased the frequency of the second higher order mode of the antenna arrangement 1200.

In these embodiments where the Leaf 1220 that is added to the Main Trunk 1210 has a main dimension that is small in relation to the quarter of a wavelength of the radiating modes of the Main Trunk, the Leaf 1220 lengthens the Main Trunk that in turn advantageously generates a decrease of the values of the resonating frequencies of the proper modes of the antenna arrangement.

The Leaf is fully active (i.e. it generates a maximum additional rotation on the Smith Chart) for a given mode when it is located at a point P that is equivalent to an Open Circuit for this mode (or Hot Spot) and therefore imparts a shift on the resonating frequency that is maximum for this mode.

Conversely, the Leaf is "transparent" (i.e. it generates no additional rotation on the Smith Chart) when it is located at a point P that is equivalent to a Short Circuit for this mode (or Cold Spot) and therefore imparts no shift on the resonating frequency for this mode.

When the Leaf is located at a point P that is intermediate between a Hot Spot and a Cold Spot, the frequency shift that is imparted by the Leaf is increasing when one moves closer to an Hot Spot and is decreasing when one moves closer to a Cold Spot.

For a given mode, the position of a point P, where a Leaf is connected, defines its electrical state parameter that is a key parameter for controlling the amplitude of the shift in frequency imparted by the Leaf.

The top extremity of the Main Trunk 1210 is a Hot Spot for all modes, while its bottom extremity is a Cold Spot for all modes.

In some instances, the calculation of the resonating frequencies knowing the design parameters of the antenna arrangement (resolution of the direct problem) and the calculation of the design parameters for obtaining a set of defined resonating frequencies (resolution of the inverse problem) may also be carried out analytically using the relationships presented below.

One uses the definitions above. Also, a resonating frequency f is given. Some characteristics of the Main Trunk 1210 are fixed: the geometry is 1D and the form factor is rectilinear. The dimension (length) of the monopole may vary. The Leaf 1220 is 2D. Its form factor and dimension may vary and allow calculating its equivalent length $\ell_{EqLeaf}(f)$ at frequency f (with $\ell_{EqLeaf}(f)\in[0,\lambda/4[$) and its input susceptance $B_{Leaf}(f)$ at frequency f (with $B_{Leaf}(f)\in[0,+\infty[$).

Starting from the canonical equation of composition of the input admittances from segment 1211 and Leaf 1220 seen at point P of location of Leaf 1220 on Main Trunk 1210 and from the relationship between the susceptance and the admittance (the susceptance being the imaginary part of the admittance), one can write:

$$B_P(f)=Y_C tg\left(\frac{2\pi f}{c}\ell'\right)+B_{Leaf}(f) \quad \text{(Eq. 11)}$$

Compounding the admittance seen in P with segment 1212, one can write:

$$Y_{1200}(f)=Y_C\times\frac{j\left[Y_C tg\left(\frac{2\pi f}{c}\ell'\right)+B_{Leaf}(f)\right]+jY_C tg\left(\frac{2\pi f}{c}\ell''\right)}{Y_C-\left[Y_C tg\left(\frac{2\pi f}{c}\ell'\right)+B_{Leaf}(f)\right]\times tg\left(\frac{2\pi f}{c}\ell''\right)} \quad \text{(Eq. 12)}$$

The antenna arrangement 1200 will resonate at a frequency $f_{res}$ that is such that the input admittance at the feed line point of the antenna has an infinite imaginary part (or susceptance), or its inverse is null. Starting from Equation 12, one finds the expression of the input susceptance of the Leaf 1220 at point P for the resonating frequency $f_{res}$:

$$B_{Leaf}(f_{res})=Y_C\left[\cot g\left(\frac{2\pi f_{res}}{c}\ell''\right)-tg\left(\frac{2\pi f_{res}}{c}\ell'\right)\right] \quad \text{(Eq. 13)}$$

One notes that the member $$tg\left(\frac{2\pi f_{res}}{c}\ell'\right)$$

is null at a Hot Spot, when $$\ell' = \frac{k\lambda_{fi}}{2},$$

$k \in N$, and the impact of the input susceptance of the Leaf at this point P is maximum. Conversely, the impact of $B_{LeafP}(f_{res})$ is minimum at a Cold Spot. It is thus possible to define an efficiency factor (or conversely a coefficient of transparency) of the position of the Leaf on the Main Trunk that is a function of the impact of the Leaf on the combined input susceptance at point P as defined by Equation 11.

To solve the direct problem, all the design parameters are set first and the resonating frequencies of the antenna arrangement 1200 are the frequencies $f_i$ that solve Equation 13.

The resolution of the inverse problem starts from a list of frequencies defined by the specification of the antenna, for all frequencies $f_i$, $i \in \{1,2, \ldots n\}$. The designer or the design tools provided according to the invention will adjust the design parameters of the antenna so as to define a plurality of resonating modes, all the frequencies of which satisfy Equation 13.

In this embodiment with a rectilinear Main Trunk and a single Leaf, the design parameters that the designer may adjust to meet the specification in terms of frequencies are:

the length $\ell$ of the Main Trunk 1210;

the location P of the Leaf 1220 on the Main Trunk ($\ell' \in [0, \ell]$);

the geometry, form factor and dimensions of the Leaf 1220 and its orientation in relation to the Main Trunk, that define its input susceptance function at point P, $B_{Leaf}(f)$.

According to the invention, the input susceptance function at a point P located on an antenna element that is a 1D rectilinear monopole antenna (whether this antenna element is a Main Trunk, a Secondary Trunk or a Branch) to which the Leaf is connected may be deduced from Equation 13.

Thus, when the input susceptance function of the Leaf $B_{Leaf}(f)$ and its position P are known, the direct problem can be solved, i.e. the resonating frequencies of the antenna arrangement can be determined. There may be a plurality of solutions to the inverse problem (i.e. find a pair (P, Leaf) that allow generating resonating frequencies of a specification). This plurality of leaves that are solutions to the inverse problem have a susceptance that satisfies Equation 13 when positioned at point P. They can be selected in a database of antenna elements. The susceptance function can be expressed as depending upon the design parameters of the Leaf, the geometry, G, the form factor, F, a characteristic dimension, D, and the orientation relative to the antenna element to which it is connected, O. We therefore have:

$$B_{Leaf}(f)=B(f, G_{Leaf}, F_{Leaf}, D_{Leaf}, O_{Leaf}) \quad \text{(Eq. 14)}$$

According to the invention, information about the susceptance function may be acquired and used according to different embodiments:

the values of the susceptance function at each frequency may be measured experimentally for different values of $G_{Leaf}$, $F_{Leaf}$, $D_{Leaf}$, $O_{Leaf}$; they will then be stored in a lookup table (LUT) or a database with a descriptor of the corresponding Leaf; the measurements may be cleaned from outliers; they may be also statistically normalized using methods known to a person of ordinary skill;

the values of the susceptance function may also be calculated using electromagnetic simulations or models; then the algorithms to perform the calculation may be themselves stored in the program developed to calculate resonating frequencies of an antenna arrangement (direct problem) or its design parameters (inverse problem), or the results of the simulation may be themselves stored in a database or lookup table as in the previous embodiment;

in some embodiments, where the geometry G, form factor F and orientation O of the Leaf are simple, it is possible to calculate $B_{Leaf}(f)$ in a simple way, as illustrated above in relation to FIGS. 5*a* and 5*b*; for instance, when the Leaf is a rectilinear element that is positioned perpendicular to a rectilinear 1D Main Trunk (FIGS. 5*a* and 5*b*), Equation 14 becomes:

$$B_{Leaf}(f) = Y_C tg\left(\frac{2\pi f}{c} D_{Leaf}\right).$$

In some embodiments of the invention, the different approaches above may be combined. For instance, experimental measurements may be used in some parts of the domain of specification (geometries, form factors, dimensions, orientations), while simulations or models may be used in other parts of the domain of specification. Also, experimental measurements may be used to calibrate simulations or models. Simulations or models may also be used to interpolate or extrapolate values of the susceptance function in-between or beyond values that have been obtained experimentally.

Artificial intelligence algorithms may also be applied to the databases/lookup tables/simulations/models defined above to solve the inverse problem, i.e. finding one or more sets of design parameters that satisfy a specification of an antenna arrangement comprising a plurality of frequencies. For instance, various kinds of neural networks may be used to explore the space of solutions much more rapidly than a pure brute force exploration.

Figure 13A:
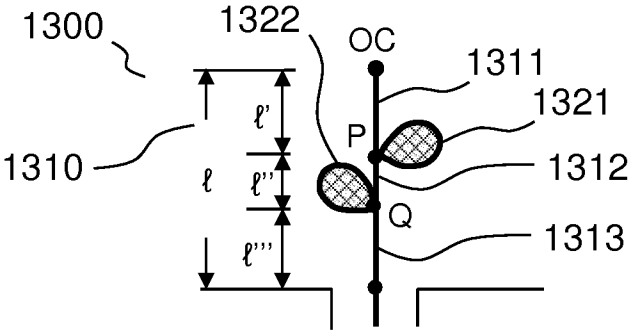
FIG. 13*a* represents two leaves located on a trunk.

FIG. 13*a* represents two leaves located on a trunk; FIGS. 13*b* and 13*c*, 13*d* and 13*e*, 13*f* and 13*g* respectively represent a configuration of the antenna arrangement of FIG. 13*a* and the calculation of its input admittance using a Smith Chart.

FIG. 13*a* represents an antenna arrangement 1300 having a first Leaf 1321 connected on a Main Trunk 1310 at a point P that defines a top segment 1311 of length $\ell'$ and a bottom segment that is itself divided in two pieces, segment 1312 of length $\ell''$ and segment 1313 of length $\ell'''$ by a point Q where a second Leaf 1322 is connected. The lengths of the segments satisfy $\ell = \ell' + \ell'' + \ell'''$.

Figure 13B:
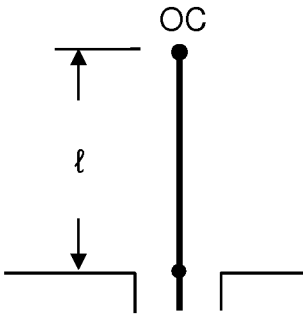
FIGS. 13*b* and 13*c*, 13*d* and 13*e*, 13*f* and 13*g* respectively represent a configuration of the antenna arrangement of FIG. 13*a* and the calculation of its input admittance using a Smith Chart.
Figure 13C:
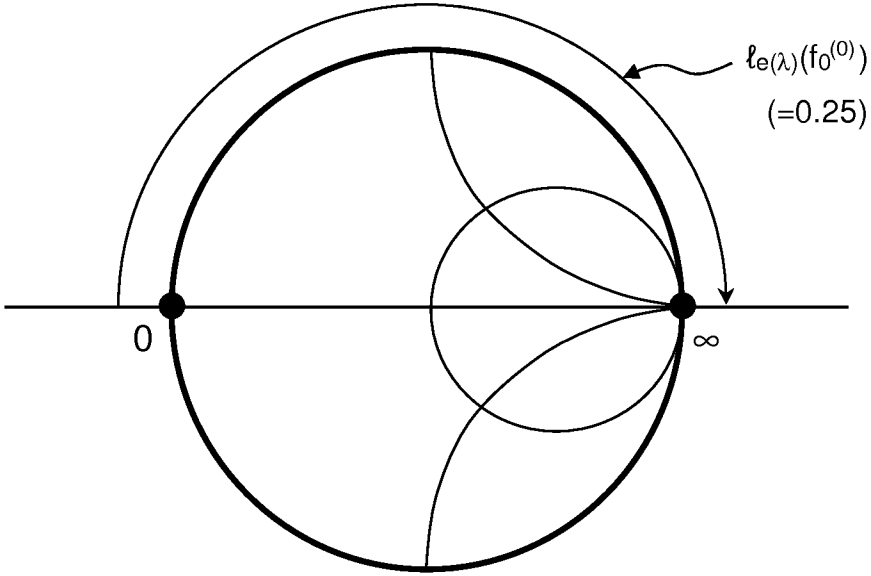

FIGS. 13*b* and 13*c* illustrate the starting point of the iterative design process where we have only a monopole antenna of length $\ell$ (see FIG. 13*b*) for which the equivalent electrical length $\ell_{e(\lambda)}(f_0^{(0)})=¼$ at frequency $f_0^{(0)}$ of the fundamental mode is reproduced on the Smith Chart (see FIG. 13*c*). The Smith Chart also allows calculating the normalized input admittance of the antenna arrangement, $Y_{1300_N}(f_0^{(0)})=j\times\infty$.

Figures 13D, 13E:
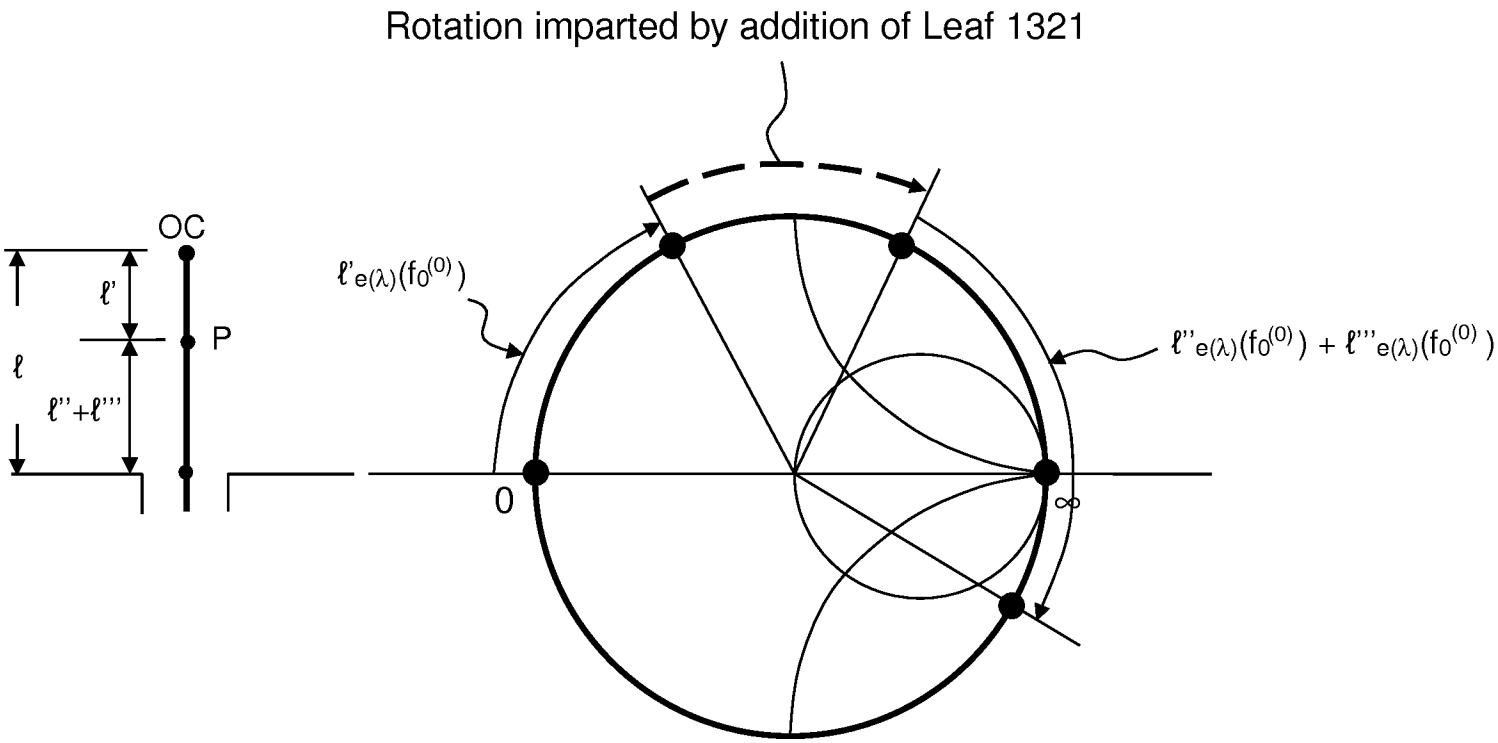

FIGS. 13*d* and 13*e* illustrate the impact of the addition of a first Leaf 1321 on the frequency of the fundamental mode of the Main Trunk 1310 in an embodiment.

In this embodiment, the lengths of segments 1311, 1312, 1313 (see FIG. 13*d*) may be defined as a fraction of the wavelength of the fundamental mode.

The definition of the parameters (geometry, form factor, dimensions) of the Leaf 1320 allow calculating the input admittance of the Leaf, $Y_{Leaf}(f_0^{(0)})$. The Leaf 1321 has in particular dimensions that are small enough for its equivalent length to be lower than $\lambda_{f_0^{(0)}}/4$. Also:

$$\ell'_{e(\lambda)}(f_0^{(0)})+\ell''_{e(\lambda)}(f_0^{(0)})+\ell'''_{e(\lambda)}(f_0^{(0)})=1/4.$$

On the Smith Chart of FIG. 13*e*, we start from the OC point on the left-hand side of the Chart, that defines the origin of the Chart for the admittances, and then move clock wise by adding the equivalent electrical length of the antenna segments, starting with one segment the distal end of which is the OC.

The procedures that are carried out and the results are similar to the ones illustrated on FIG. 12*d* that are commented above in the description.

Figure 13F:
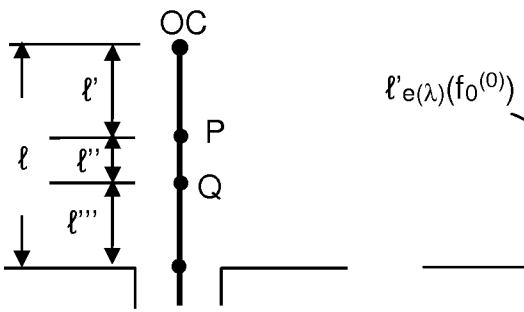
Figure 13G:
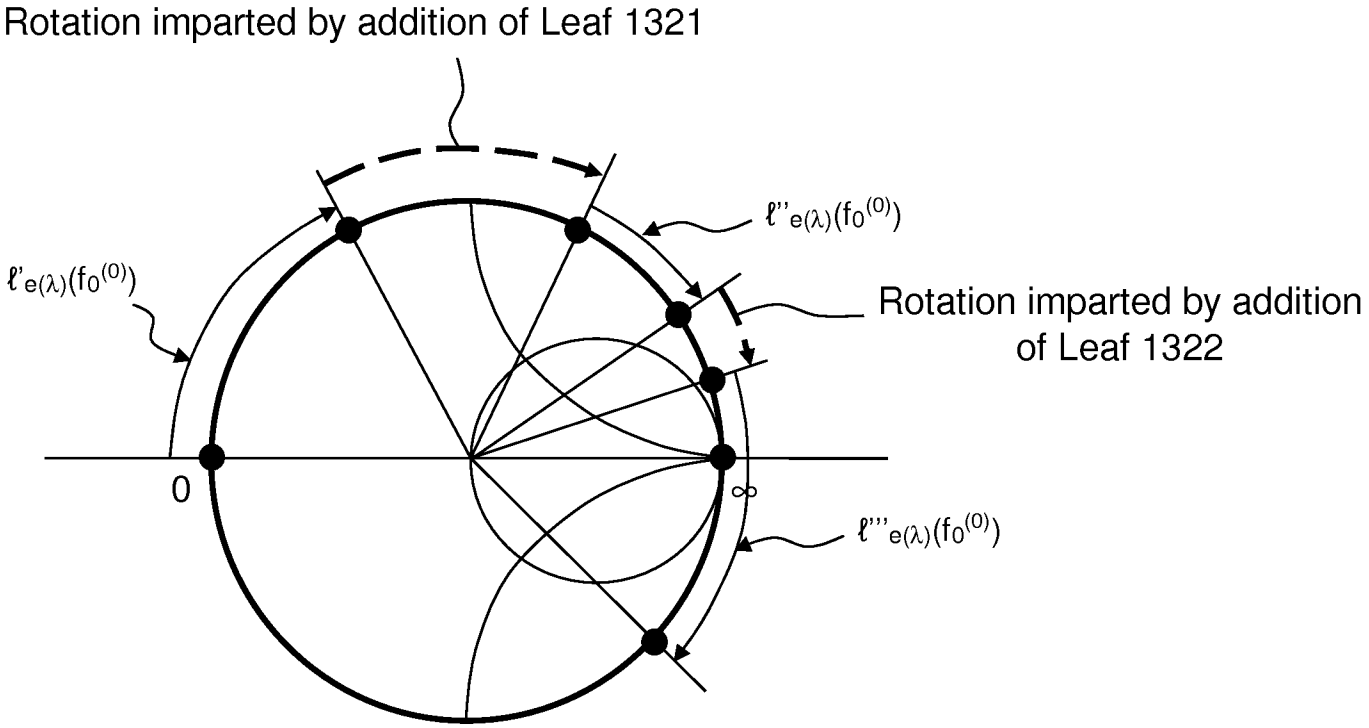

FIGS. 13*f* and 13*g* illustrate the impact of the addition of a second Leaf 1322 on the frequency of the fundamental mode of the Main Trunk 1310 in an embodiment.

Equation 10 may be generalised and add the impact of the second Leaf 1322 and of the third segment 1313 on the compounded admittances.

On the Smith Chart that determines a total rotation $Rot_{Ant}$, the normalized input admittance of the antenna arrangement, $Y_{1300_N}(f_0^{(0)})$ can be read.

$Rot_{Ant}$ satisfies Equation 15 below:

$$Rot_{Ant}=\ell'_{e(\lambda)}(f_0^{(0)})+Rot_{Leaf1321}+\ell''_{e(\lambda)}(f_0^{(0)})+Rot_{leaf1322}+\ell'''_{e(\lambda)}(f_0^{(0)}) \quad \text{(Eq. 15)}$$

$Rot_{Leaf\,1321}$ and $Rot_{Leaf\,1322}$ are calculated as exemplified above in relation to Equation 10.

The increase of the equivalent electrical length of the antenna is higher with two Leaves than with only one Leaf. Therefore, the decrease in frequency of the fundamental mode is higher. We will have a new resonating frequency $f_0^{(2)}$ for the fundamental mode that will be such that $\ell_{1300}(f_0^{(2)})=\lambda_{f_0^{(2)}}/4$. We have the following inequalities: $f_0^{(2)}<f_0^{(1)}<f_0^{(0)}$.

The same procedures and conclusions apply for higher order modes.

The direct problem of defining the set of frequencies of the resonating modes of an antenna arrangement of the type of FIG. 13*a* may also be solved analytically, using the same rules of combination of the admittances/susceptances of the antenna elements at their points of connection that were explained above.

For doing so, one replaces segment 1311 (that is electrically connected in parallel with Leaf 1321 at point P) by a segment of an equivalent length $\ell'_{EqLeafP\,II}\ell$, that is defined in such a way that Equation 16 below is satisfied:

$$tg\left(\frac{2\pi f}{c}\ell'_{EqLeafP//\ell'}(f)\right)=tg\left(\frac{2\pi f}{c}\ell'\right)+\frac{B_{LeafP}(f)}{Y_C} \quad \text{(Eq. 16)}$$

When adding a second Leaf 1322 at point Q, one uses Equation 13 while replacing:

$\ell'$ by $(\ell'_{EqLeafP\,II}\ell,+\ell'')$;

$\ell''$ by $\ell'''$;

Leaf by LeafQ.

The solutions to the problem must then satisfy Equation 16 above and Equation 17 below:

$$B_{LeafQ}(f_{ref})=Y_C\left[\cot g\left(\frac{2\pi f_{res}}{c}\ell''\right)-tg\left(\frac{2\pi f_{res}}{c}(\ell'_{EqLeafP//\ell'}(f_{res})+\ell'')\right)\right] \quad \text{(Eq. 17)}$$

The resolution of the inverse problem starts from a list of frequencies defined by the specification of the antenna, $f_i$, $i\in\{1,2,\ldots n\}$. The designer will adjust the design parameters of the antenna so as to define a plurality of resonating modes the frequencies of which all satisfy Equations 16 and 17.

In this embodiment with a rectilinear Main Trunk and two Leaves, the design parameters that the designer may adjust to meet the specification in terms of frequencies are:

the length $\ell$ of the Main Trunk 1310;

the locations P and Q of the Leaves 1321 and 1322 on the Main Trunk ($\ell'$, $\ell''\in[0,\ell]$);

the geometries, form factors and dimensions of the Leaves 1321, 1322 and their orientations in relation to the Main Trunk, that define their input susceptance function, $B_{Leaf}(f)$ at points P and Q.

The comments made above about $B_{Leaf}(f)$ equally apply to this embodiment.

In this embodiment with a Main Trunk and two Leaves It is therefore possible to define eleven independent design parameters, three out of the four length parameters, $\ell$, $\ell'$, $\ell''$, $\ell'''$, the four length parameters being linked by $\ell=\ell'+\ell''+\ell'''$ and four parameters (geometry, form factor, dimension and orientation) for each Leaf:

$G_{P,Q}\in\{1D, 2D, 3D\}$ $F_{P,Q}\in\{\text{wire, triangle, drop}\ldots\}$;

$D_{P,Q}\in[0,\lambda_{f_n}/4]$;

$O_{P,Q}\in[90°-\alpha,90°+\alpha]$.

The "wire" geometry/form factor is illustrated on FIGS. 5*a* and 5*b* that have been commented upon above. The "drop" geometry/form factor is illustrated on FIGS. 5*c* and 5*d*. The "triangle" geometry is a 2D Leaf that is a triangle.

The characteristic dimension D must be lower than $\lambda_{f_n}/4$ as already indicated.

The orientation may be defined by the angle between a characteristic axis of the Leaf and the Main Trunk.

As discussed above, the resolution of the inverse problem lies in finding the sets of design parameters that satisfy Equations 16 and 17 above for all frequencies of the specification. It may be that there is no exact solution for all frequencies. Then, it is possible to define a cost function as a sum of the squares of the difference between each actual susceptance and each target susceptance for each frequency of the specification. Possibly the squares of the differences may be weighted to favour one or more of the frequencies in the specification. The cost function can then be formulated as:

$$CF=\sum_{i=0}^{n}w_j\Big(B_{LeafQ}(f_i)- \quad \text{(Eq. 18)}$$

-continued $$Y_C\left[\cot g\left(\frac{2\pi f_i}{c}\ell''\right) - tg\left(\frac{2\pi f_i}{c}(\ell'_{EqLeafP//\ell'}(f_i) + \ell'')\right)\right]^2$$

Of course, in a number of embodiments, the weights may be selected to be all equal to one.

Various algorithms may be used to solve this cost function, such as a gradient descent learning algorithm, possibly in combination with a neural network algorithm.

According to the invention, it is possible to generalize the solutions applied to the direct problem in the embodiment with two Leaves described above to embodiments with three or more Leaves. This can be done when the solution that is found after applying the resolution process described above is too far from an optimum solution. A threshold can be defined to automatically stop the process, or the process may be stopped when the designer decides to do so, because the gain in matching the specification would be less than the cost (both in non-recurrent expenses and in bill of materials) of adding a new antenna element.

As part of the design process of an antenna according to this invention, it may be beneficial to use electromagnetic simulation tools that use the theory of the characteristic modes in combination with the Method of Moments. See for instance: R. J. Garbacz and R. H. Turpin, "A generalized expansion for radiated and scattered fields", IEEE Trans. Antennas Propagation, vol. AP-19, n°3, pp 348-358, May 1971; R. F. Harrington and J. R. Mautz, "Theory of characteristic modes for conducting bodies", IEEE Trans. Antennas Propagation, vol. AP-19, n°5, pp 622-628, September 1971; R. F. Harrington and J. R. Mautz, "Computation of characteristic modes for conducting bodies", IEEE Trans. Antennas Propagation, vol. AP-19, n°5, pp 629-639, September 1971; R. F. Harrington and J. R. Mautz, "Characteristic modes for dielectric and magnetic bodies", IEEE Trans. Antennas Propagation, vol. AP-20, n°2, pp 194-198, March 1972.

Such tools are available in COTS (Commercial Off The Shelf) such as FEKO™ and CST™ that implement the Method of Moments (MoM) . . . . They allow designing electromagnetic devices and antennas from a description of their materials and geometries. They allow a representation of the distribution of current for each of the resonating modes of the antenna, without having to actually transmit or receive electromagnetic waves. The selectivity of each of the resonating modes may be assessed using a quality factor (in void), thus allowing a fair prediction of the bandwidth for matching level at a defined value. The process implemented in one of these tools may be applied at each step of the design method, allowing the calculation of the values of the different resonating frequencies of the antenna arrangement, or of some parts thereof, as well as the associated electrical performances of each element, to check compliance with the specification. The calculations may be performed at the level of the combined antenna arrangement. A person of ordinary skill of antenna design knows, once aware of the present disclosure how to chain the various steps of simulation to achieve a complete design matching the specification.

Using such tools, it is therefore possible to build a library of antenna elements with their characteristic parameters defined according to the invention, then computing the susceptances of each element and solving, either in an exact manner, in some instances, or in an approximated manner, with a known sub-optimality cost, the equations generalized from equations 16, 17 and 18 above.

The invention may also be applied to dipole antennas. A dipole antenna is a two poles antenna where the two poles are excited by a differential generator. The two poles of the dipole antenna each operate with stationary regimes which have the same behavior. The two pole antennas each have a structure with a trunk, one or more branches and one or more leaves. In some embodiments of the invention, the two structures are symmetrical.

The examples disclosed in this specification are therefore only illustrative of some embodiments of the invention. They do not in any manner limit the scope of said invention which is defined by the appended claims.

The invention claimed is:

1. An antenna arrangement comprising:

a primary conductive element having defined geometric parameters, the primary conductive element having a proximal end and a distal end, the proximal end being connected at a feed line, the distal end being an open circuit position, the primary conductive element defining a first plurality of resonating frequencies;

one or more secondary conductive elements, each having defined geometric parameters, a proximal end and a distal end, the proximal end being connected at a feed connection on the primary conductive element, the distal end being an open circuit position and defining an orientation relative to the primary conductive element, the one or more secondary conductive elements generating a second plurality of resonating frequencies;

wherein the frequencies in the second plurality of resonating frequencies each satisfy a condition of resonance at the feed line, the condition of resonance being determined by a sequence of combinations of input susceptances of a segment of the primary conductive element and of one of the one or more secondary conductive elements, each combination being generated at the feed connection of the said one of the one or more secondary conductive elements on the primary conductive element, a segment of the primary conductive element connecting one of its distal end or a feed connection of another of the one or more secondary conductive elements to the one of the one or more secondary elements, the sequence starting from the distal end of the primary conductive element and ending at its proximal end.

2. The antenna arrangement of claim 1, wherein the second plurality of resonating frequencies is deduced from the first plurality of resonating frequencies by one or more of shifting one or more frequency values, enlarging a bandwidth of one or more frequencies in the plurality of resonating frequencies, or adding one or more new resonating frequencies.

3. The antenna arrangement of claim 1, wherein the input susceptance of a segment of the primary conductive element is determined by the defined geometric parameters of the said primary conductive element.

4. The antenna arrangement of claim 1, wherein the input susceptance of each one of the one or more secondary conductive elements depends on the defined geometric parameters of the said each one of the one or more secondary conductive elements, and on its orientation relative to the primary conductive element.

5. The antenna arrangement of claim 1, wherein the defined geometric parameters of the primary conductive element and of each one of the one or more secondary elements comprise a geometry, a form factor and a main dimension.

6. The antenna arrangement of claim 1, wherein one of the one or more secondary conductive elements has a main dimension that is lower than a quarter of a wavelength corresponding to a highest value in the second plurality of resonating frequencies of the antenna arrangement, the addition of the one or more secondary conductive elements having an effect of shifting one or more of the first plurality of resonating frequencies of the antenna arrangement.

7. The antenna arrangement of claim 1, wherein one of the one or more secondary conductive elements has a main dimension that is higher than a quarter of a wavelength corresponding to a highest value in the second plurality of resonating frequencies of the antenna arrangement and lower than a quarter of a wavelength corresponding to the lowest value in the second plurality of resonating frequencies of the antenna arrangement.

8. The antenna arrangement of claim 7, wherein the addition of the one or more secondary conductive elements has an effect of adding one or more potential new resonating frequencies to the first plurality of resonating frequencies of the antenna arrangement, the new resonating frequencies having values in between a value corresponding to a wavelength equal to a quarter of the main dimension of the said one of the one or more secondary conductive elements and the highest value in the second plurality of resonating frequencies.

9. The antenna arrangement of claim 8, wherein one or more of the potential new resonating frequencies are new resonating frequencies if they are sufficiently separated from the all frequency values in the first plurality of resonating frequencies.

10. The antenna arrangement of claim 8, wherein the addition of the one of the one or more secondary conductive elements has an effect of shifting one or more resonating frequencies in the first plurality of resonating frequencies of the antenna arrangement having values in between the lowest value and the highest value in the second plurality of resonating frequencies, when the one of the one or more secondary conductive elements has a feed connection that is not located at the feed line.

11. The antenna arrangement of claim 1, further comprising one or more ternary conductive elements, each having defined geometric parameters, a proximal end and a distal end, the proximal end being connected at a feed connection on one of the one or more secondary conductive elements, the distal end being an open circuit position and defining an orientation relative to the one of the one or more secondary conductive elements.

12. The antenna arrangement of claim 11, further comprising one or more quaternary conductive elements each having defined geometric parameters, a proximal end and a distal end, the proximal end being connected at a feed connection on one of the one or more ternary conductive elements, the distal end being an open circuit position and defining an orientation relative to the one of the one or more ternary conductive elements.

13. A method of designing an antenna arrangement comprising:

defining a primary conductive element with determined geometric parameters, the primary conductive element having a proximal end and a distal end, the proximal end being connected at a feed line, the distal end being an open circuit position, the primary conductive element defining a first plurality of resonating frequencies;

defining one or more secondary conductive elements, each having determined geometric parameters, a proximal end and a distal end, the proximal end being connected at a feed connection on the primary conductive element, the distal end being an open circuit position and defining an orientation relative to the primary conductive element, the one or more secondary conductive elements generating a second plurality of resonating frequencies;

wherein the geometric parameters of the primary conductive element and of the one or more secondary conductive elements are determined in such a way that the frequencies in the second plurality of resonating frequencies each satisfy a condition of resonance at the feed line, the condition of resonance being determined by a sequence of combinations of input susceptances of a segment of the primary conductive element and of one of the one or more secondary conductive elements, each combination being generated at the feed connection of the said one of the one or more secondary conductive elements on the primary conductive element, a segment of the primary conductive element connecting one of its distal end or a feed connection of another of the one or more secondary conductive elements to the one of the one or more secondary elements, the sequence starting from the distal end of the primary conductive element and ending at its proximal end.

14. The method of claim 13, wherein the one or more secondary conductive elements are iteratively added at defined locations to the primary conductive element so as to match a specification of the antenna arrangement comprising the second plurality of predefined frequencies.

15. The method of claim 14, wherein the one or more secondary conductive elements that are added to match the specification of the antenna arrangement are further defined to match a specified bandwidth for at least one or more frequencies in the second plurality of predefined frequencies.

16. The method of claim 13, wherein the one or more secondary conductive elements that are added to match a specification are further defined to match a form factor of the antenna arrangement.

17. The method of claim 13, wherein the one or more secondary elements are drawn from a database of predefined elements.

18. The method of claim 17, wherein the predefined elements have been generated by using one or more of a graphical calculation based on Smith Charts, an analytical computation, a simulation tool or a model.

19. The method of claim 13, wherein the matching the specification is performed by using one or more of a graphical calculation based on Smith Charts, an analytical computation, a simulation tool or a model.

20. The method of claim 19, wherein the matching the specification if further performed by optimizing a cost function.

* * * * *